US009795522B2

(12) United States Patent
Hansen et al.

(10) Patent No.: US 9,795,522 B2
(45) Date of Patent: Oct. 24, 2017

(54) COLLAPSIBLE MANUAL WHEELCHAIR SYSTEM FOR IMPROVED PROPULSION AND TRANSFERS

(71) Applicant: THE UNITED STATES OF AMERICA AS REPRESENTED BY THE DEPARTMENT OF VETERANS AFFAIRS, Washington, DC (US)

(72) Inventors: Andrew H. Hansen, Minneapolis, MN (US); Gary D. Goldish, Minneapolis, MN (US); Eric Nickel, Minneapolis, MN (US)

(73) Assignee: THE DEPARTMENT OF VETERANS AFFAIRS, Washington, DC (US)

( * ) Notice: Subject to any disclaimer, the term of this patent is extended or adjusted under 35 U.S.C. 154(b) by 0 days.

(21) Appl. No.: 15/269,794

(22) Filed: Sep. 19, 2016

(65) Prior Publication Data

US 2017/0007477 A1 Jan. 12, 2017

Related U.S. Application Data

(63) Continuation-in-part of application No. 14/776,642, filed as application No. PCT/US2014/022080 on
(Continued)

(51) Int. Cl.
*A61G 5/00* (2006.01)
*A61G 5/02* (2006.01)
(Continued)

(52) U.S. Cl.
CPC ..... *A61G 5/023* (2013.01); *A61G 5/026* (2013.01); *A61G 5/0825* (2016.11); *A61G 5/0875* (2016.11); *A61G 5/1054* (2016.11)

(58) Field of Classification Search
CPC ..... A61G 5/00; A61G 5/0875; A61G 5/0883; A61G 5/0891
See application file for complete search history.

(56) References Cited

U.S. PATENT DOCUMENTS

| | | | |
|---|---|---|---|
| 2,946,602 | A | 7/1960 | Lee |
| 3,901,527 | A | 8/1975 | Danziger et al. |
| 3,994,509 | A | 11/1976 | Schaeffer |
| 4,099,277 | A | 7/1978 | Watkins |

(Continued)

FOREIGN PATENT DOCUMENTS

| | | | |
|---|---|---|---|
| CN | 201719455 | U | 1/2011 |
| JP | 2003-265537 | A | 9/2003 |
| JP | 2012-143519 | A | 8/2012 |

OTHER PUBLICATIONS

International Search Report and Written Opinion issued in PCT International Application No. PCT/US2014/022080, dated Jun. 19, 2014, 15 pages.

*Primary Examiner* — John Walters
*Assistant Examiner* — James Triggs
(74) *Attorney, Agent, or Firm* — Procopio Cory Hargreaves and Savitch LLP; Pattric J Rawlins

(57) ABSTRACT

A manual wheelchair including a collapsible frame having a first lateral member that is connected to first and second braces at their respective first ends. A drive wheel axel extends along a first axis of rotation and engages a drive wheel, the first brace, and a portion of a transmission. A push rim axel extends along a second axis of rotation and engages a push rim wheel, the second brace, and a portion of the transmission, which transmits rotation of the push rim to rotation of the drive wheel. The collapsible frame additionally includes a second lateral member that is connected to the first and second braces as their respective second ends. The first and second braces are configured to release the second lateral member to collapse the manual wheelchair.

19 Claims, 39 Drawing Sheets

Related U.S. Application Data

Mar. 7, 2014, now Pat. No. 9,445,958, which is a continuation of application No. 13/827,840, filed on Mar. 14, 2013, now Pat. No. 8,905,421.

(60) Provisional application No. 62/385,183, filed on Sep. 8, 2016.

(51) Int. Cl.
*A61G 5/10* (2006.01)
*A61G 5/08* (2006.01)

(56) References Cited

U.S. PATENT DOCUMENTS

| | | | | |
|---|---|---|---|---|
| 4,155,588 | A | 5/1979 | Danziger et al. | |
| 4,422,660 | A | 12/1983 | Costello et al. | |
| 4,625,984 | A | 12/1986 | Kitrell | |
| 4,732,402 | A | 3/1988 | Lambert et al. | |
| 5,482,305 | A | 1/1996 | Jeffries et al. | |
| 6,257,608 | B1 | 7/2001 | Hanson | |
| 6,419,260 | B1 | 7/2002 | Kuroda | |
| 6,802,518 | B2 | 10/2004 | Kuntz | |
| 7,464,949 | B1 | 12/2008 | Downey | |
| 7,717,447 | B2 | 5/2010 | Orford | |
| 7,900,945 | B1 | 3/2011 | Rackley | |
| 2008/0238023 | A1 | 10/2008 | Bloom | |
| 2009/0051139 | A1 | 2/2009 | Kylstra et al. | |
| 2009/0295119 | A1 | 12/2009 | Bloswich et al. | |
| 2014/0265211 | A1* | 9/2014 | Hansen | A61G 5/026 280/250 |
| 2016/0038355 | A1* | 2/2016 | Hansen | A61G 5/026 280/250.1 |

* cited by examiner

COLLAPSIBLE MANUAL WHEELCHAIR SYSTEM FOR IMPROVED PROPULSION AND TRANSFERS

RELATED APPLICATIONS

The present application is a continuation-in-part of U.S. patent application Ser. No. 14/776,642 filed on 14 Sep. 2015, now U.S. Pat. No. 9,445,958, which is the U.S. National Stage of PCT/US2014/022080 filed on 7 Mar. 2014, which claims priority to U.S. patent application Ser. No. 13/827,840 filed on 14 Mar. 2013, now U.S. Pat. No. 8,905,421, each of which is incorporated herein by reference in its entirety as if set forth in full. The present application also claims the benefit of U.S. provisional patent application No. 62/385,183 filed on 8 Sep. 2016, which is incorporated herein by reference in its entirety as if set forth in full.

BACKGROUND

Field of the Invention

The purpose of the invention is to provide a collapsible wheelchair system that allows for independent positioning of the push rims and drive wheels, allowing for improved stability and improved shoulder biomechanics. The approach also allows for the addition of multispeed fixed-gear hubs for improved propulsion on sloped surfaces and allows for removal or repositioning of the push rims out of the way for easier transfers in and out of the wheelchair.

Related Art

The most common form of a manual wheelchair 100 utilizes a push rim 110 connected directly to the drive wheels 120 as shown in FIG. 1. The wheelchair user is able to propel the wheelchair 100 by pushing the push rims 110 with their hands, thereby rotating the wheel an equal angle and translating the chair forward. The common wheelchair is elegant in its simplicity. However, the inherent mechanical coupling of the push rim 110 and the wheel 120 require that they be placed in the same fore-aft position, which may lead to reduced stability of the wheelchair and/or shoulder problems. In setup of the common wheelchair, the clinician must balance concerns of shoulder biomechanics and stability of the wheelchair. On one hand, the clinician would like to move the push rims forward to promote a better positioning of the shoulders for propulsion. On the other hand, the axel of the wheels 120 must remain behind the center of gravity 130 to reduce the likelihood the wheelchair 100 will tip over backward. A common approach is to move the push rim/wheel combination 110/120 as far forward as possible while still maintaining a stable base 150 of support of the wheelchair by positioning the drive wheel 120 and front casters 140 to frame the center of gravity 130 in fore/aft directions.

The positioning of the push-rim/wheel 110/120 combination in common wheelchairs leads to difficulties in transfers (transferring in and out of the wheelchair 100). For example, the user must position the wheelchair at an angle with a bed 200 or other transfer surface in order to use a transfer board 210 (see FIG. 2). Without a transfer board, the person must elevate their body a significant distance to clear the wheel of the wheelchair (FIGS. 3A, 3B).

Therefore, what is needed is a system and method that overcomes these significant problems found in the conventional systems as described above.

SUMMARY

Described herein is a new collapsible manual wheelchair system that decouples the push rims from the drive wheels of the wheelchair and reconnects the push rims to the drive wheels using a belt drive or chain drive transmission, thus allowing for optimal stability and better shoulder positioning for propulsion. The push rims are also removable or rotatable for easier transfers. The wheelchair can also include multispeed fixed-gear hubs for easier propulsion on different terrain. The wheelchair advantageously reduces shoulder problems that are common in persons who use manual wheelchairs while maintaining optimal stability. The wheelchair is also collapsible.

Other features and advantages of the present invention will become more readily apparent to those of ordinary skill in the art after reviewing the following detailed description and accompanying drawings.

BRIEF DESCRIPTION OF THE DRAWINGS

The structure and operation of the present invention will be understood from a review of the following detailed description and the accompanying drawings in which like reference numerals refer to like parts and in which.

DETAILED DESCRIPTION

Certain implementations disclosed herein provide for a manual wheelchair that allows for optimization of stability and shoulder biomechanics for individual wheelchair users. For example, one apparatus disclosed herein provides a wheelchair having a drive wheel rotatable about a first axis of rotation, a push rim rotatable about a second axis of rotation, which is offset from the first axis of rotation, and a transmission coupling the push rim to the drive wheel.

Additionally, some implementations disclosed herein provide for a manual wheelchair that allows for the positioning of the push rim to allow transfer into and out of the wheelchair. For example, one apparatus disclosed herein provides a wheelchair having a push rim repositioning mechanism that allows the push rim to be rotated between a propulsion position and a transfer position.

After reading this description it will become apparent to one skilled in the art how to implement the invention in various alternative embodiments and alternative applications. However, although various embodiments of the present invention will be described herein, it is understood that these embodiments are presented by way of example only, and not limitation. As such, this detailed description of various alternative embodiments should not be construed to limit the scope or breadth of the present invention as set forth in the appended claims.

Figure 4A:
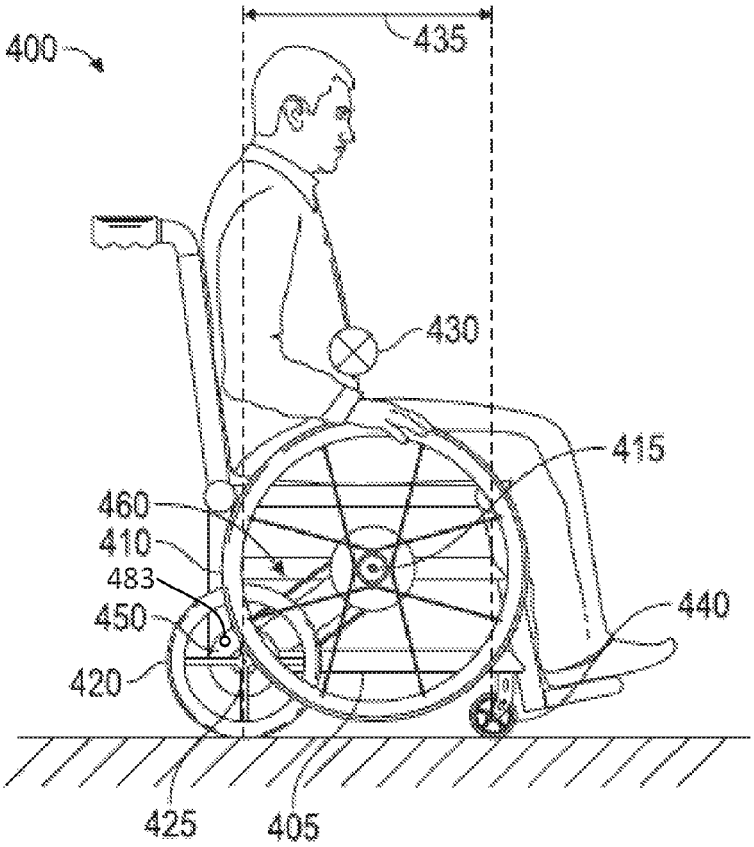
FIGS. 4A-4D are diagrams illustrating an example wheelchair with a push rim capable of being rotated backward and out of the way for transfers according to a first implementation of the present application.
Figure 4B:
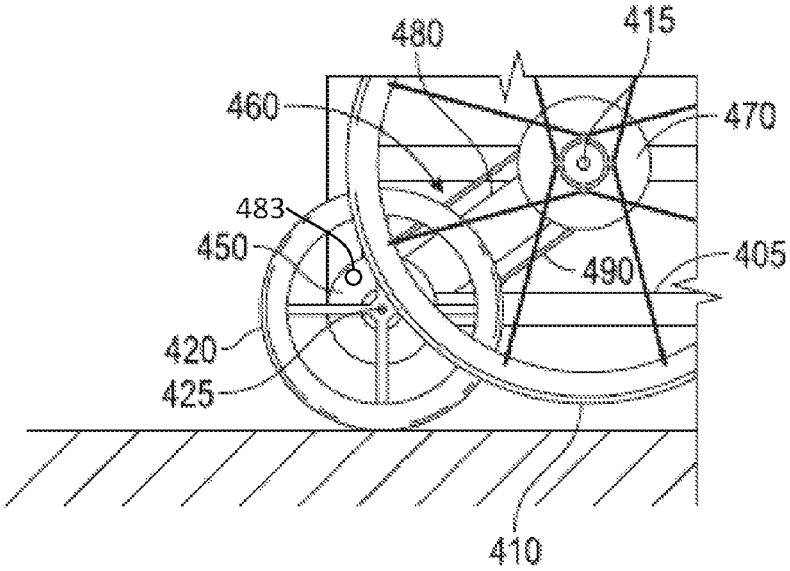
Figure 4C:
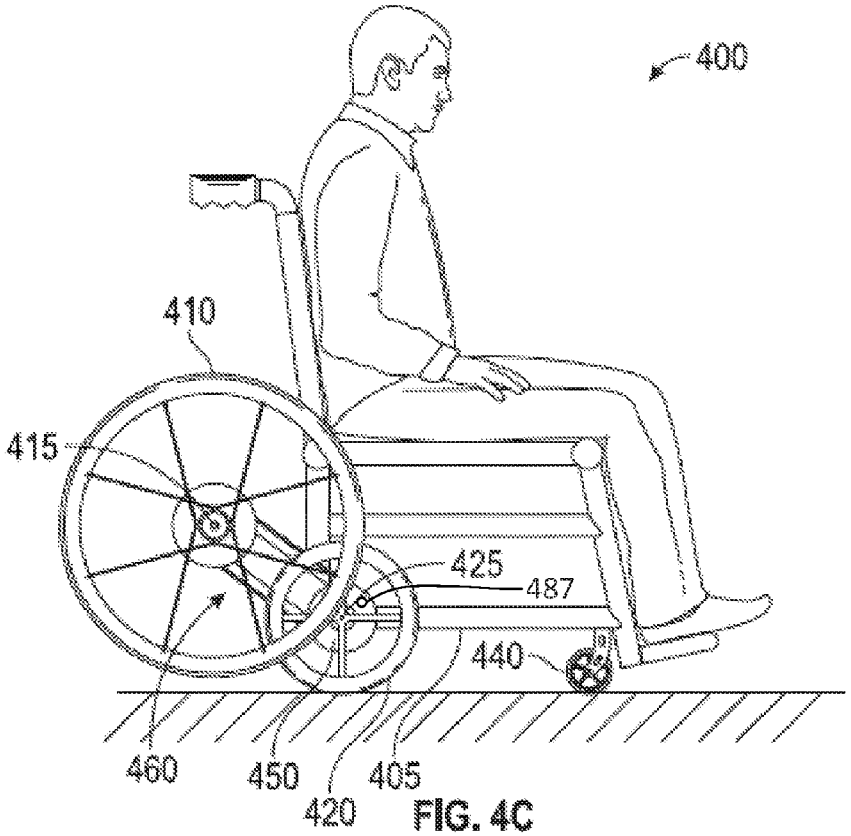
Figure 4D:
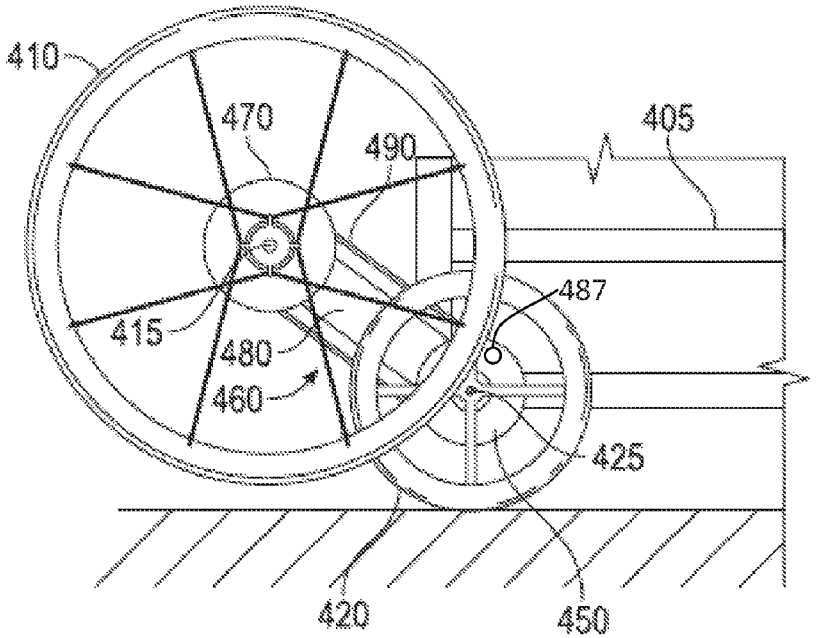

FIGS. 4A-4D are diagrams illustrating an example wheelchair with a push rim capable of being rotated backward and out of the way for transfers according to a first implementation of the present application. More specifically, FIG. 4A illustrates the wheelchair with the push rim rotated forward into a propulsion position. Further, FIG. 4B illustrates an enlarged view of the push rim relocation mechanism in the propulsion position. Further, FIG. 4C illustrates the wheelchair with the push rim rotated backward into a transfer position. Further, FIG. 4D illustrates an enlarged view of the push rim relocation mechanism in the transfer position.

In this implementation, the wheelchair 400 includes a frame 405, a rotatable push rim 410 connected to the frame 405 and a drive wheel 420 connected to the frame 405. The wheelchair 400 may also include caster wheels 440 located in front of the drive wheel 420. The caster wheels 440 and the drive wheels 420 collectively form the base of support 435 of the wheelchair. In order to provide a stable ride for the user, it may be preferable that caster wheels 440 and the drive wheels be positioned such that the user's center of gravity 430 is located directly above the base of support 435, rather than in front of or behind the base of support 435.

As shown in FIGS. 4A-4D, the axis of rotation 425 of the drive wheel 420 is offset from the axis of rotation 415 of the push rim. Thus, instead of being directly coupled to each other, the push rim 410 and drive wheel 420 are connected by a transmission 460. The transmission 460 may include a drive gear/hub 450 coupled to drive wheel 420, a push rim gear/hub 470 coupled to the push rim 410, and a chain or belt 490 connected to the drive gear/hub 450 and the push rim gear/hub 470.

Thus, de-coupling the fore-aft position of the push rims 410 and drive wheels 420 may allow a clinician to place the drive wheels 420 in their optimal position to provide a stable base of support 435 while still allowing the person to do "wheelies" if needed (to go over curbs and other thresholds). Also, the position of the push rims 410 can be set to promote the best positioning of the wheelchair 400 user's shoulders. A potential aspect of this more forward positioning of the push rims 410 is a reduction in shoulder pain resulting from manual propulsion of the wheelchair. In other words, de-coupling of the push rims 410 and drive wheels 420 may allow the clinician to place the push rims 420 in front of the user's center of gravity 430 as shown in FIGS. 4A-4D, potentially improving mechanical efficiency without sacrificing wheelchair stability.

Additionally, the use of the transmission 460 with the belts or chains 490 may allow the wheelchair to also incorporate into one or both of the drive gear/hub 450 and the push rim gear/hub 470 a multispeed fixed-gear hub such as the Sturmey-Archer S3X fixed-gear hub. In such implementations, the ability to switch to higher or lower speeds may allow the wheelchair user to go faster on smooth even terrain and to require less torque and forces on the shoulders to go up inclined terrain.

Figure 1:
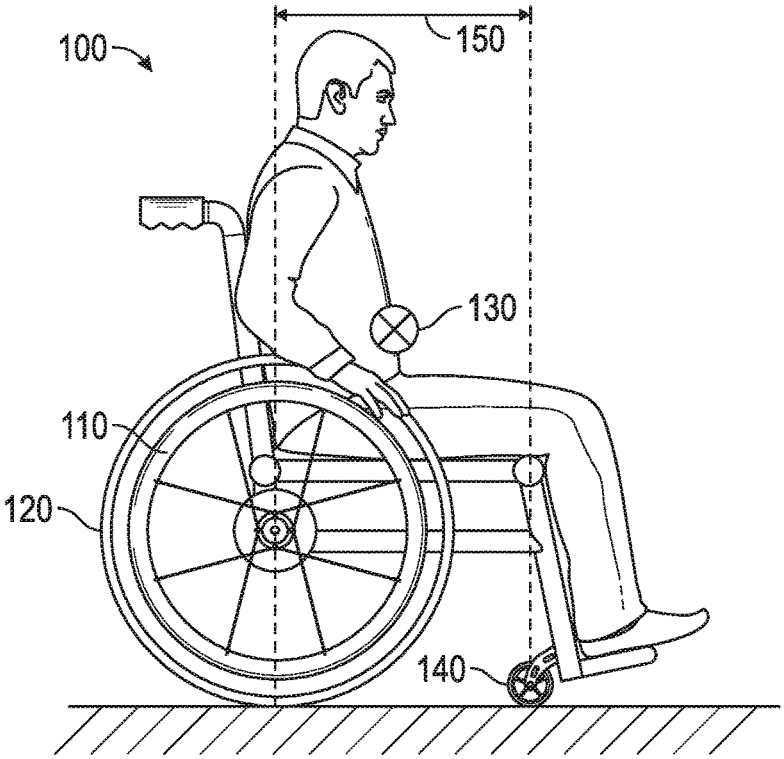
FIG. 1 (Related Art)
FIG. 1 is a diagram illustrating an example related art wheelchair.
Figure 2:
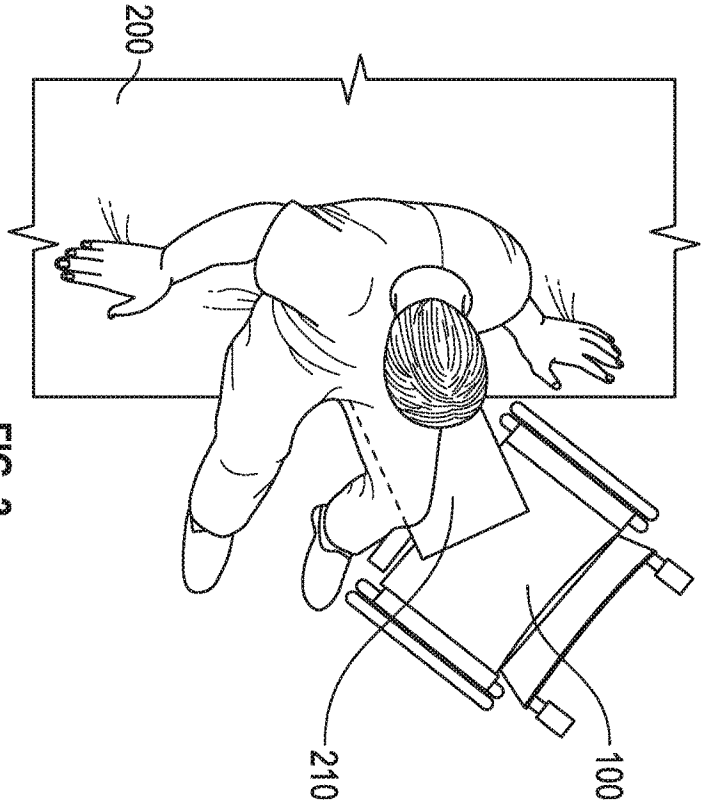
FIG. 2 (Related Art)
FIG. 2 is a diagram illustrating an example related art wheelchair transfer with a transfer board.
Figure 3A:
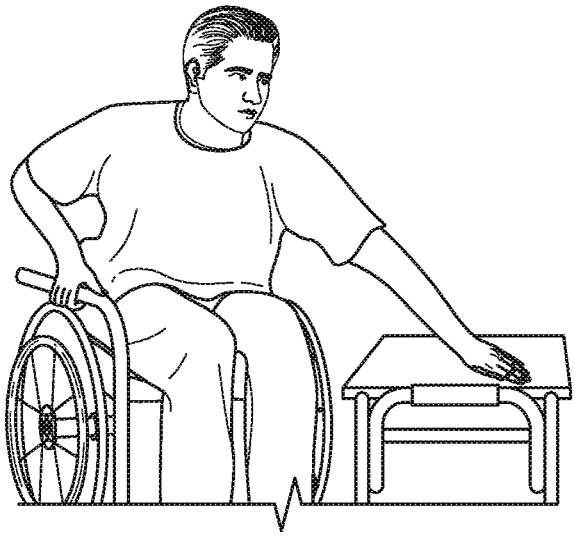
FIG. 3A (Related Art)
FIGS. 3A and 3B are diagrams illustrating an example related art wheelchair transfer without a transfer board.
Figure 3B:
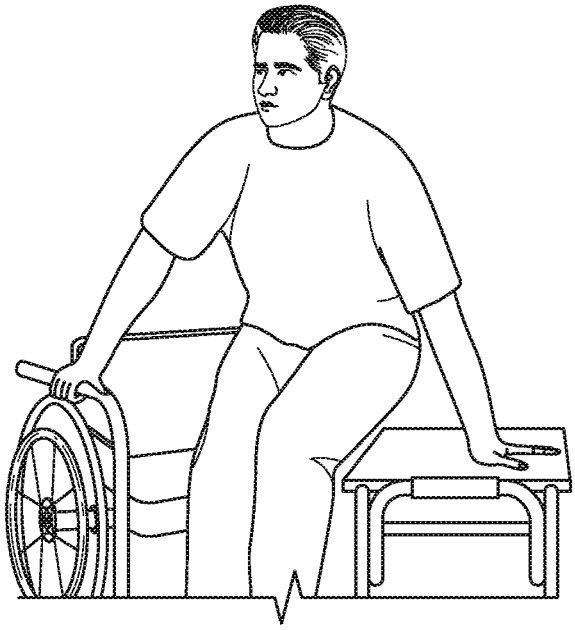
FIG. 3B (Related Art)

Additionally, in some implementations, the wheelchair 400 also includes a push rim repositioning member 480 that allows the push rim 410 to be repositioned to allow a user to transfer into and out of wheelchair 400 without having to lift himself over the push rim as shown in FIGS. 3A and 3B above. In FIGS. 4A-4D, the repositioning member 480 is a swing arm rotatably mounted to the frame 405 and configured to rotate about the axis of rotation 425 of the drive train. As shown, the push rim gear/hub 470 and push rim 410 are located at a first end of the swing arm 480 and the drive wheel gear/hub 450 is located at a second end of the swing arm 480 and the belt/chain 490 extends along the length of the swing arm. As shown in FIGS. 4A and 4B, the swing arm 480 can be rotated forward to position the push rim 410 forward of a user's shoulders to allow the propulsion of the wheel chair by the user (known as the propulsion position). As shown in FIGS. 4C and 4D, the swing arm 480 can be rotated backward to position the push rim 410 behind a user's shoulders to allow the user to transfer into and out of the wheelchair.

Additionally, in some embodiment, a locking mechanism 483 may be provided to releasably hold the push rim repositioning member 480 (swing arm) in the propulsion position shown in FIGS. 4A and 4B. Further, a second locking mechanism 487 or hard stop may also be provided to releasably hold or limit the rearward rotation of the push rim repositioning member 480 (swing arm) in the transfer position shown in FIGS. 4C and 4D.

Though various aspects of this embodiment are shown in the figures and discussed above, implementations of this application are not limited to these aspects and alternative implementations are discussed below.

Figure 5A:
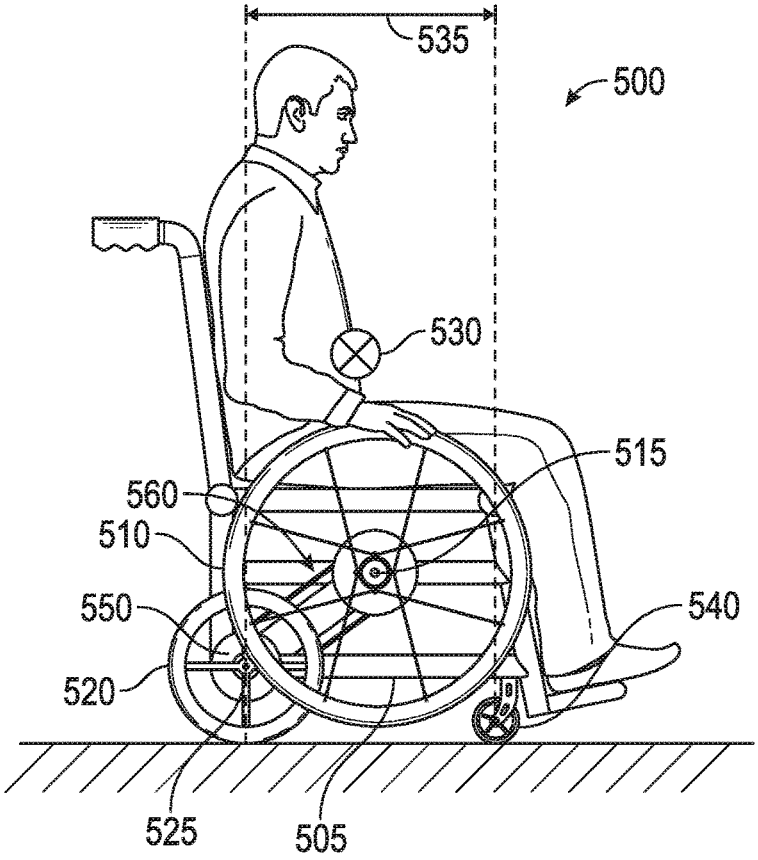
FIGS. 5A-5D are diagrams illustrating an example wheelchair with a push rim capable of being removed and placed out of the way for transfers according to a second implementation of the present application.
Figure 5B:
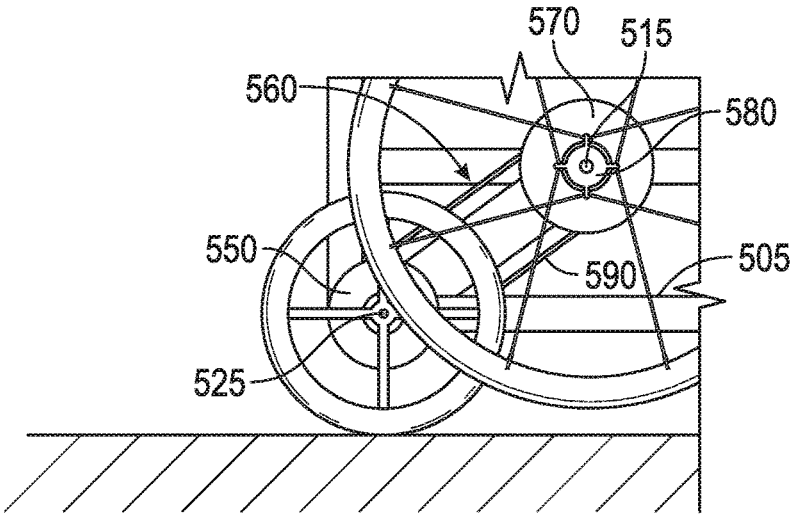
Figure 5C:
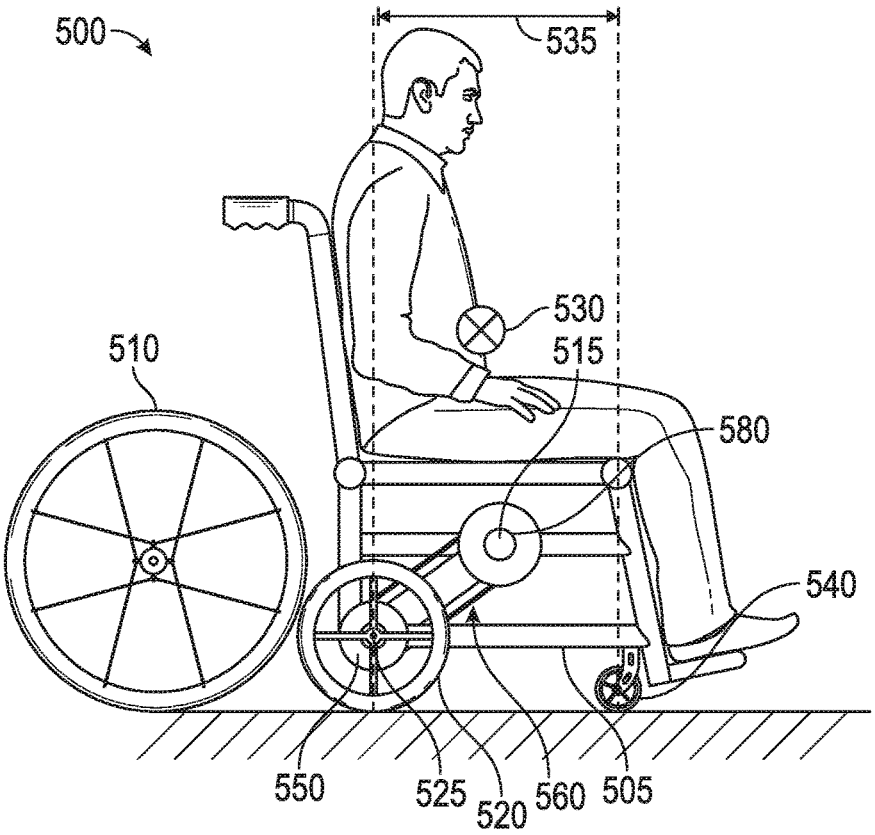
Figure 5D:
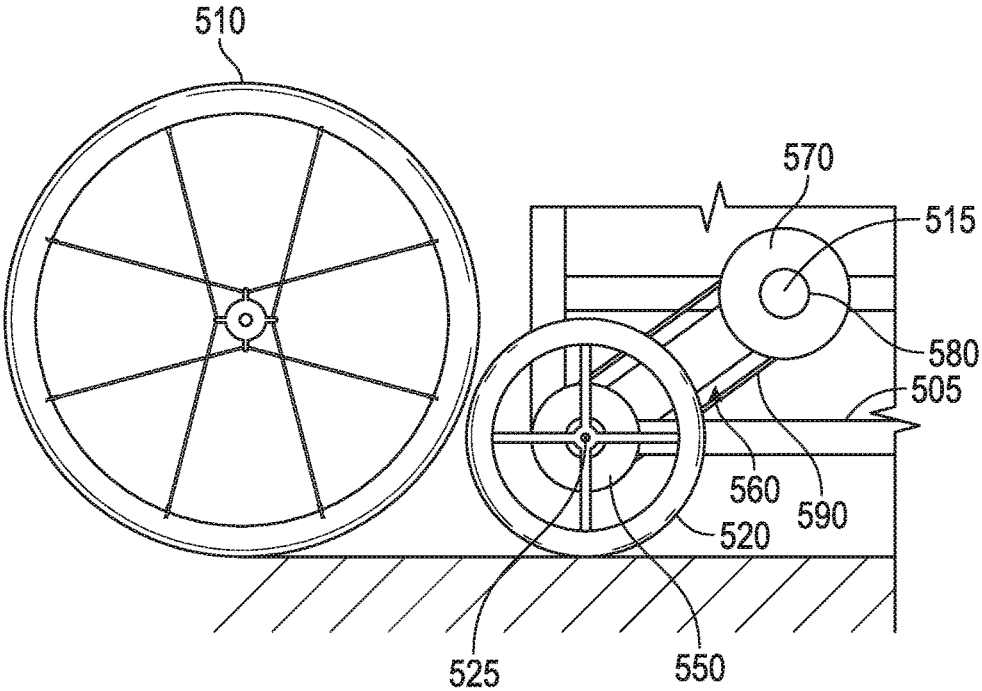

FIGS. 5A-5D are diagrams illustrating an example wheelchair with a push rim capable of being removed and placed out of the way for transfers according to a second implementation of the present application. More specifically, FIG. 5A illustrates the wheelchair with the push rim attached to the wheelchair in a propulsion position. Further, FIG. 5B illustrates an enlarged view of the push rim relocation mechanism with the push rim attached in the propulsion position. Further, FIG. 5C illustrates the wheelchair with the push rim disconnected from the wheelchair and repositioned for a transfer. Further, FIG. 5D illustrates an enlarged view of the push rim removed for a transfer.

As with the implementation discussed above, in this implementation the wheelchair 500 includes a frame 505, a rotatable push rim 510 connected to the frame 505 and a drive wheel 520 connected to the frame 505. The wheelchair 500 may also include caster wheels 540 located in front of the drive wheel 520. Again, the caster wheels 540 and the drive wheels 520 collectively form the base of support 535 of the wheelchair. In order to provide a stable ride for the user, it may be preferable that caster wheels 540 and the drive wheels be positioned such that the user's center of gravity 530 is located directly above the base of support 535, rather than in front of or behind the base of support 535.

As shown in FIGS. 5A-5D, the axis of rotation 525 of the drive wheel 520 is offset from the axis of rotation 515 of the push rim 510. Thus, instead of being directly coupled to each other, the push rim 510 and drive wheel 520 are connected by a transmission 560. The transmission 560 may include a drive gear/hub 550 coupled to drive wheel 520, a push rim gear/hub 570 coupled to the push rim 510, and a chain or belt 590 connected to the drive gear/hub 550 and the push rim gear/hub 570.

Again, de-coupling the fore-aft position of the push rims 510 and drive wheels 520 may allow a clinician to place the drive wheels 520 in their optimal position to provide a stable base of support 535 while still allowing the person to do "wheelies" if needed (to go over curbs and other thresholds). Also, the position of the push rims 510 can be set to promote the best positioning of the wheelchair 500 user's shoulders. A potential aspect of this more forward positioning of the push rims 510 is a reduction in shoulder pain resulting from manual propulsion of the wheelchair. In other words, de-coupling of the push rims 510 and drive wheels 520 may allow the clinician to place the push rims 520 in front of the user's center of gravity 530 as shown in FIGS. 5A-5D, potentially improving mechanical efficiency without sacrificing wheelchair stability.

Again, the use of the transmission 560 with the belts or chains 590 may allow the wheelchair to also incorporate into either one or both of the drive gear/hub 550 and the push rim gear/hub 570 a multi-speed fixed-gear hub such as the Sturmey-Archer S3X fixed-gear hub, for example. In such implementations, the ability to switch to higher or lower speeds may allow the wheelchair user to go faster on smooth even terrain and to require less torque and forces on the shoulders to go up inclined terrain.

Additionally, in some implementations, the wheelchair 500 also includes a push rim repositioning member 580 that allows the push rim 510 to be repositioned to allow a user to transfer into and out of wheelchair 500 without having to lift himself over the push rim as shown in FIGS. 3A and 3B above. In the implementation shown in FIGS. 5A-5D, the repositioning member 580 is release mechanism that allows the push rim 510 to be disconnected from the frame 505. For example, a quick release mechanism could be used to allow the push rim 510 to be removably attached to the frame 505. As shown in FIGS. 5A and 5B, the release mechanism (push rim repositioning member 580) holds the push rim 510 forward of a user's shoulders to allow propulsion of the wheelchair by the user (known as the propulsion position). As shown in FIGS. 5C and 5D, the release mechanism (push rim repositioning member 580) allows the push rim 510 to be disconnected from the frame 505, and once disconnected, the push rim 510 can be placed behind a user's shoulders to allow the user to transfer into and out of the wheelchair.

Though various aspects of this embodiment are shown in the figures and discussed above, implementations of this application are not limited to these aspects and alternative implementations are discussed below.

Figure 6:
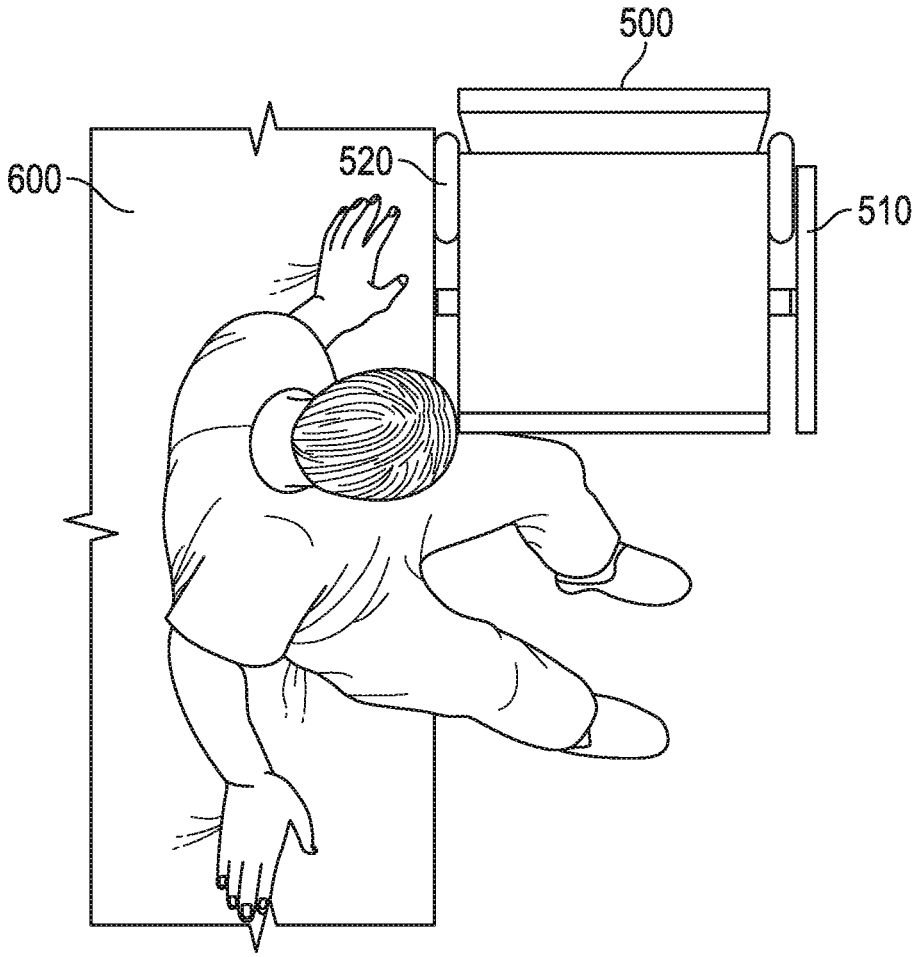
FIG. 6 is a block diagram illustrating an example transfer of a patient from a bed to a wheelchair according to an embodiment of the invention.

FIG. 6 is a block diagram illustrating an example transfer of a patient from a bed to a wheelchair according to an embodiment of the invention.

By incorporating a push rim reposition member, such as shown in the implementations of FIGS. 4A-4D and FIGS. 5A-5D, the wheelchair 500 can now be placed directly next to the bed 600 or other transfer surface, reducing the distance to transfer and also reducing the height to elevate the body since the user no longer needs to clear the wheel 520 or the push rim 510 or the combination.

Figure 7B:
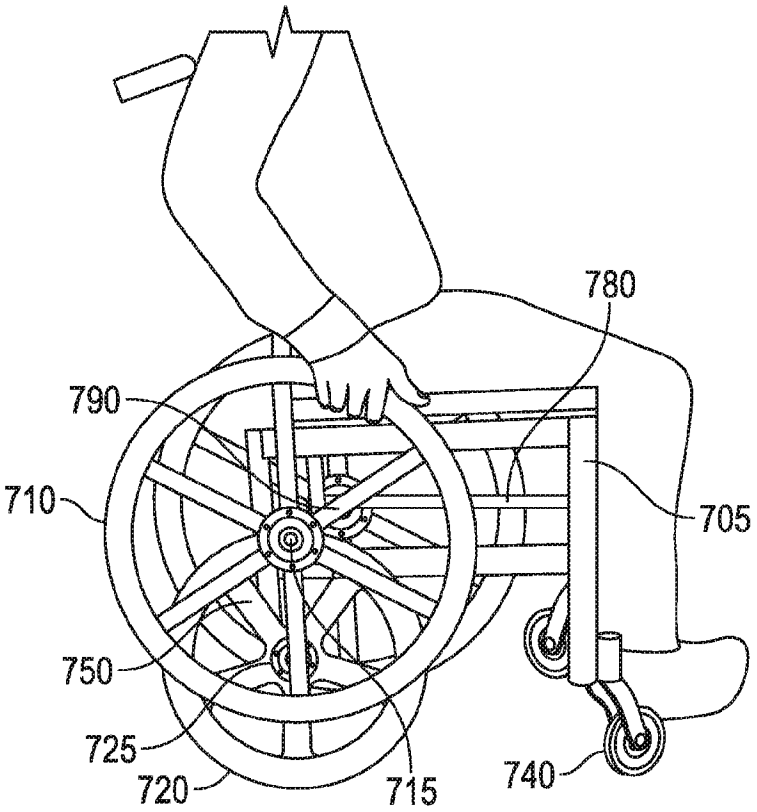
FIGS. 7A-7B are diagrams illustrating an example wheelchair with a push rim capable of being translated backward and out of the way for transfers according to a third implementation of the present application.
Figure 7A:
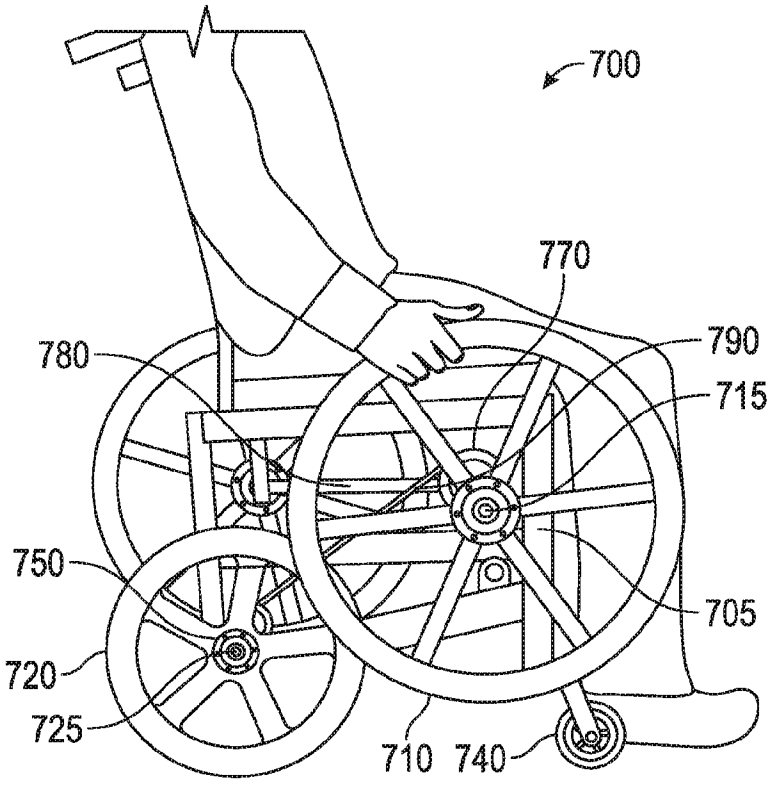

FIGS. 7A-7B are diagrams illustrating an example wheelchair with a push rim capable of being rotated backward and out of the way for transfers according to a third implementation of the present application. More specifically, FIG. 7A illustrates the wheelchair with the push rim to the wheelchair located in a propulsion position. Further, FIG. 7B illustrates the wheelchair with the push rim repositioned into a transfer position.

This implementation shown in FIGS. 7A and 7B may include features and elements similar to those discussed above with respect to the first and second implementations. Thus redundant descriptions thereof may be omitted. As with the implementations discussed above, in this implementation the wheelchair 700 includes a frame 705, a rotatable push rim 710 connected to the frame 705 and a drive wheel 720 connected to the frame 705. The wheelchair 700 may also include caster wheels 740 located in front of the drive wheel 720.

As shown in FIGS. 7A-7B, the axis of rotation 725 of the drive wheel 720 is offset from the axis of rotation 715 of the push rim. Thus, instead of being directly coupled to each other, the push rim 710 and drive wheel 720 are connected by a transmission (not specifically labeled in FIGS. 7A and 7B; individual components labeled). The transmission may include a drive gear/hub 750 coupled to drive wheel 720, a push rim gear/hub 770 coupled to the push rim 710, and a chain or belt 790 connected to the drive gear/hub 750 and the push rim gear/hub 770.

Again, de-coupling the fore-aft position of the push rims 710 and drive wheels 720 may allow a clinician to place the drive wheels 720 in their optimal position to provide a stable base of support while still allowing the person to do "wheelies" if needed (to go over curbs and other thresholds). Also, the position of the push rims 710 can be set to promote the best positioning of the wheelchair 700 user's shoulders. A potential aspect of this more forward positioning of the push rims 710 is a reduction in shoulder pain resulting from manual propulsion of the wheelchair. In other words, decoupling of the push rims 710 and drive wheels 720 may allow the clinician to place the push rims 720 in front of the user's center of gravity as shown in FIGS. 5A-5D, potentially improving mechanical efficiency without sacrificing wheelchair stability.

Again, the use of the transmission with the belts or chains 790 may allow the wheelchair to also incorporate a multi-speed fixed-gear hub to provide the ability to switch to higher or lower speeds and thereby allow the wheelchair user to go faster on smooth even terrain and to require less torque and forces on the shoulders to go up inclined terrain.

Additionally, in some implementations, the wheelchair 700 also includes a push rim repositioning member 780 that allows the push rim 710 to be repositioned to allow a user to transfer into and out of wheelchair 700 without having to lift himself over the push rim as shown in FIGS. 3A and 3B above. In FIGS. 7A-7B, the repositioning member 580 is a guide rail extending along the frame 705 that the push rim 710 can be slid along. Thus, the push rim 710 may be slidingly mounted to the guide rail (push rim repositioning mechanism 780) and repositioned at different portions along the length of the guide rail (push rim repositioning mechanism 780). As shown in FIG. 7A, the push rim 710 has been slid forward along the guide rail (push rim repositioning mechanism 780) to be located forward of a user's shoulders to allow the propulsion of the wheel chair by the user (known as the propulsion position). As shown in FIG. 7B, the push rim 710 has been slid backward along the guide rail (push rim repositioning mechanism 780) to be located behind or even with a user's shoulders to allow the user to transfer into and out of the wheelchair.

Additionally, in some implementations, a locking mechanism (not shown) may be provided to releasably hold the push rim 710 (swing arm) in the propulsion position located in front of the user's shoulders as shown in FIG. 7A. Further, a second locking mechanism (not shown) or hard stop may also be provided to releasably hold or limit the rearward movement of the push rim 710 in the transfer position shown in FIG. 7B. Additionally, in some embodiments, the transmission of the wheel chair may also include an idler sprocket (not shown), which can be used to maintain a fixed tension in the belt or chain 790.

Though various aspects of this embodiment are shown in the figures and discussed above, implementations of this application are not limited to these aspects and alternative implementations are discussed below.

Figure 9:
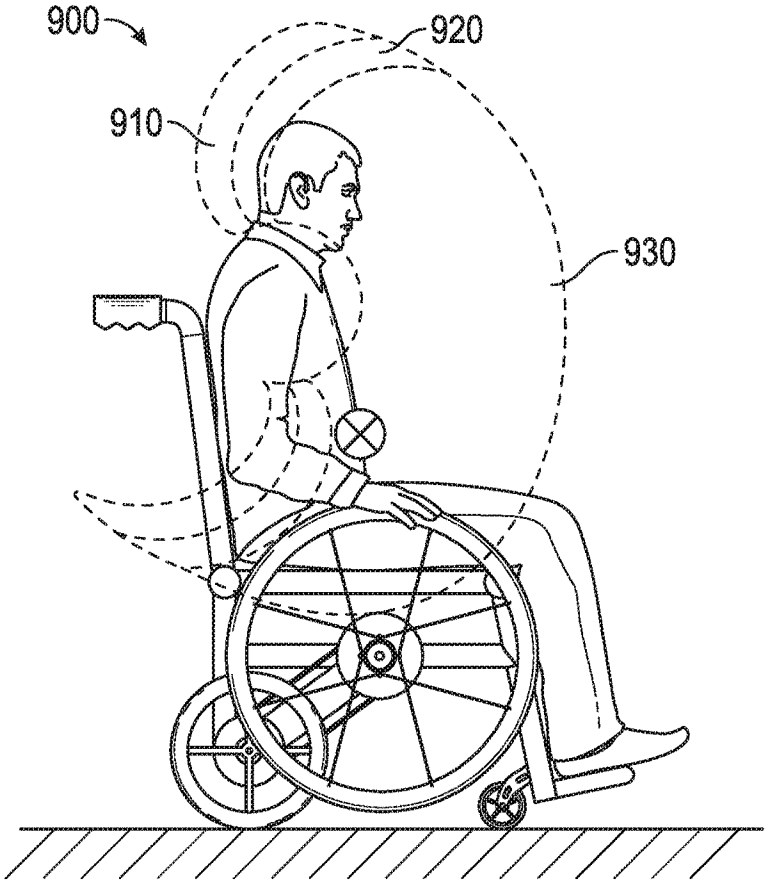
FIG. 9 is a diagram illustrating a user's range of motion laid over a diagram of a wheelchair according to an implementation of the present application.
Figure 8:
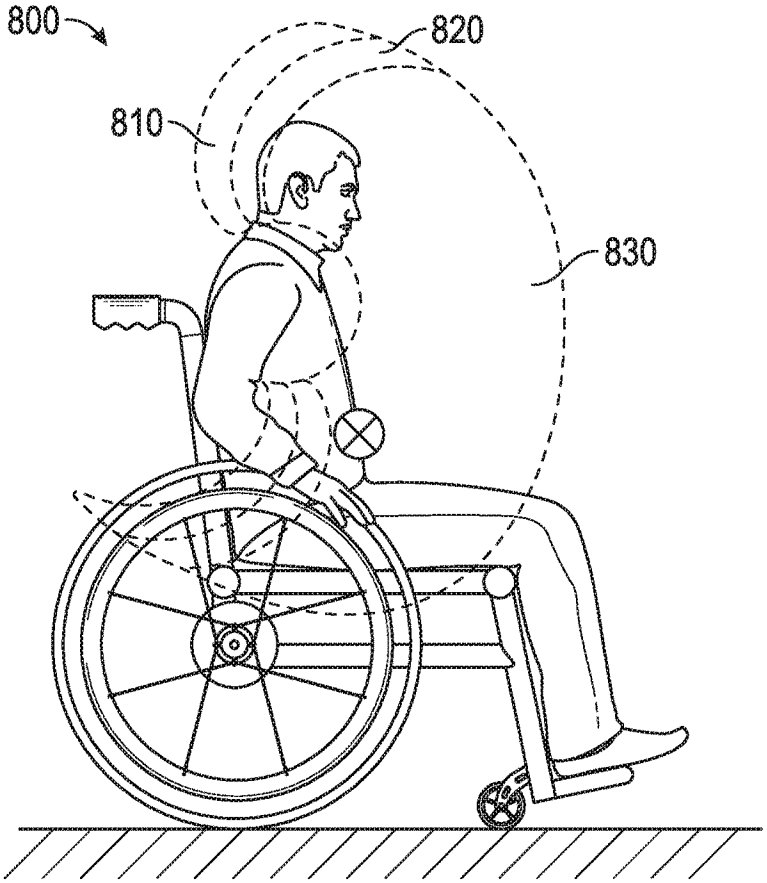
FIG. 8 (Related Art)
FIG. 8 is a diagram illustrating a user's range of motion laid over a diagram of an example related art wheelchair.

FIG. 8 illustrates the reachable workspace of a user's wrist for different shoulder ranges of motion laid over a diagram of an example related art wheelchair 800 and FIG. 9 illustrates the reachable workspace of a user's wrist for different shoulder ranges of motion laid over a diagram of a wheelchair 900 according to an implementation of the present application. As discussed above, a problem with conventional wheelchairs relates to the positioning of the drive wheel/push rim assembly relative to the user's shoulders. Rearward placement of the drive wheel/push rim assembly can improve stability, but such placement can require a user to continually reach backward with shoulder extension and sometimes shoulder abduction. Use of the shoulders in excessive extension and in abduction are thought to be damaging for repeated use. Also, some users may have experienced reduced range of motion that can limit the propulsive force that can be generated by the user. FIGS. 8 and 9 illustrate a hypothetical user's range of motion laid over diagrams of a related art wheelchair 800 and a wheelchair 900 according to an implementation of the present application. Specifically, in FIGS. 8 and 9, regions 810, 910 represent a user with a full range of motion, regions 820, 920 represent a user with a slightly reduced range of motion, and regions 830, 930 represent a reduced range of motion. As shown in FIG. 8, in order to achieve and maximize the arc of propulsion by starting the application of torque at the upper surface of the push rim of the conventional wheel chair, the user needs to take his shoulders into large angles of extension (i.e. into region 810). However, by moving the push rims forward in an implementation according to the present application, the user may be able to apply a maximum arc of propulsion with less shoulder extension (i.e. outside region 910, and into regions 920, 930).

Figure 10A:
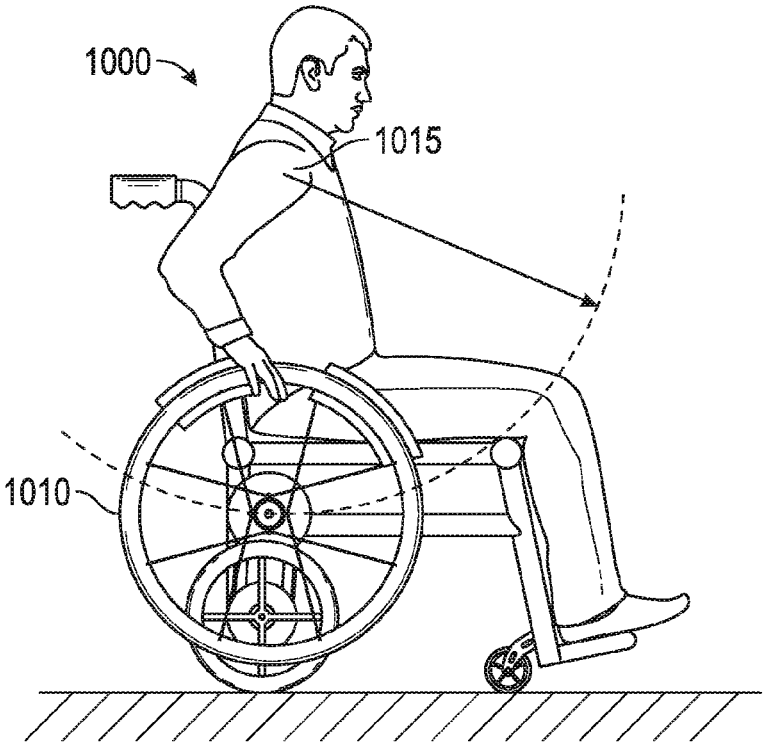
FIGS. 10A-10C are diagrams illustrating placement of a push rim at different positions along a wheelchair according to an implementation of the present application.
Figure 10B:
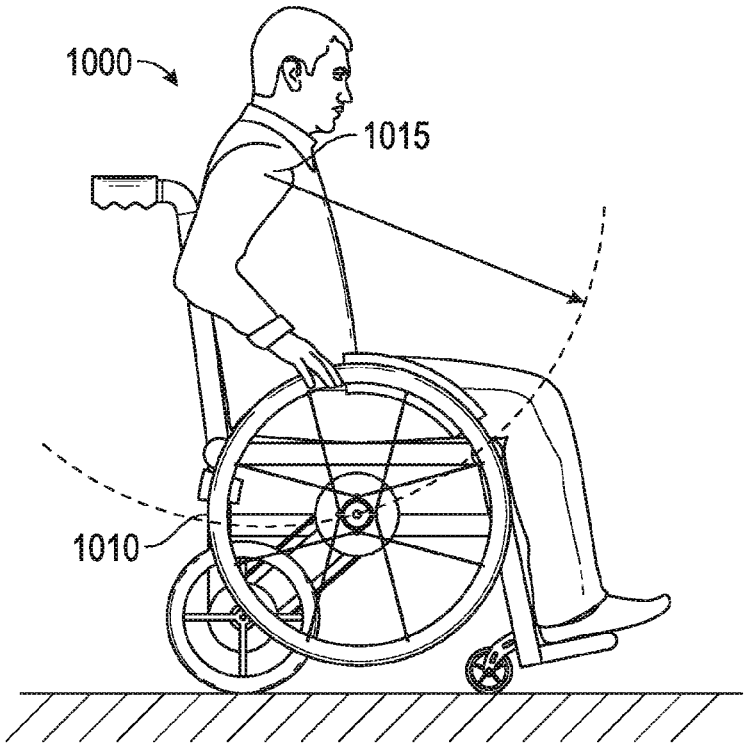
Figure 10C:
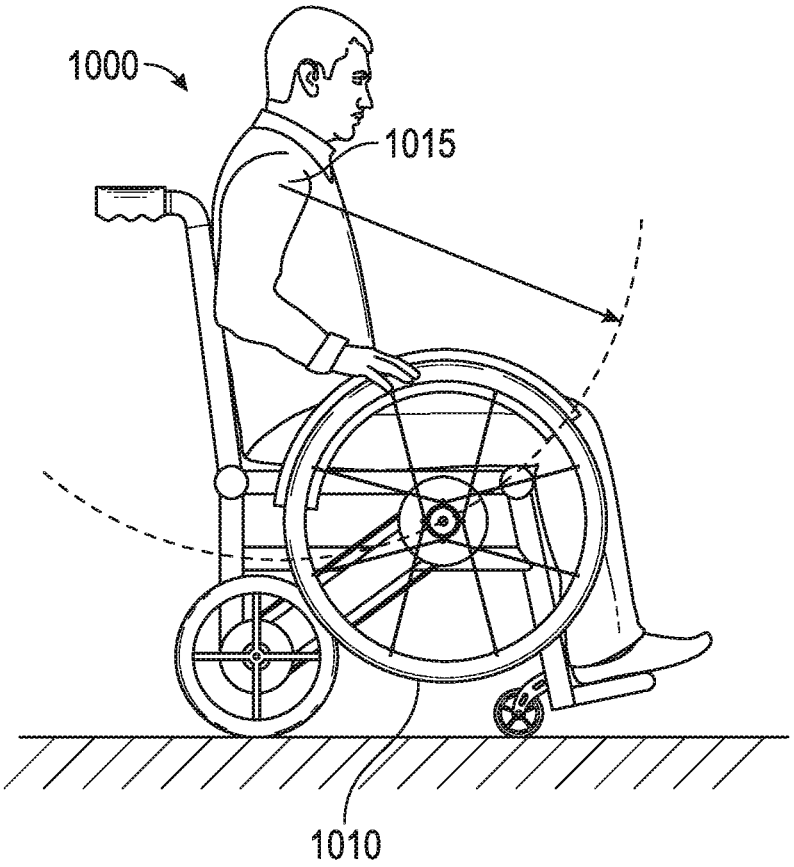

In the implementations discussed above, the push rim was shown being movable between a propulsion position and a transfer position. However, implementations of the present invention need not have only two positions. Instead, a wheelchair according to the present application may include a push rim repositioning mechanism configured to allow customizable placement of the push rim based on a user's specific physical dimensions and/or physical capabilities and/or the activities that the patient is involved in. FIGS. 10A-10C illustrate placement of a push rim at various positions along a wheelchair according to an implementation of the present application based on a user's range of motion. FIG. 10A illustrates the push rim 1010 of the wheelchair 1000 in position even with the user's shoulders 1015. FIG.

10B illustrates the push rim 1010 of the wheelchair 1000 rotated forward by 15 degrees with respect to the user's shoulders 1015. FIG. 10C illustrates the push rim 1010 of the wheelchair 1000 rotated forward by 15 degrees with respect to the user's shoulders 1015.

FIGS. 11A-27 illustrate a collapsible implementation of the present application. It should be noted that in order to simplify the description, only one side of the collapsible wheelchair is illustrated and described. However, as will be understood by the skilled artisan, the collapsible wheelchair can be implemented having mirror parts and functionality on the opposite side of the wheelchair. Alternatively, the opposite side of the wheelchair may be implemented with different parts and functionality to provide increased usability. For example, one side of the wheelchair may include a push rim that rotates backward while the other side of the wheelchair may include a removable push rim. All of the various combinations of the functionality disclosed herein are contemplated by the inventors as acceptable combinations.

Figure 11A:
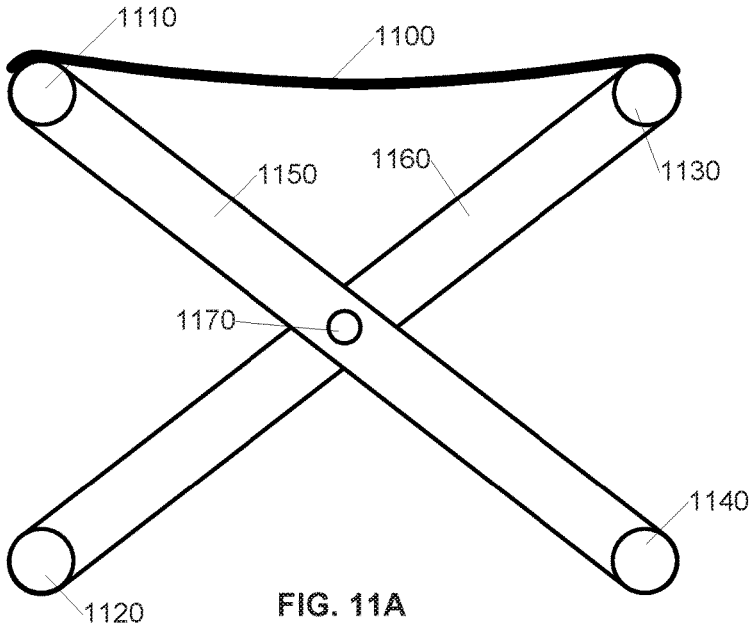
FIGS. 11A-11B are front view diagrams illustrating a collapsible wheelchair frame according to related art.
Figure 11B:
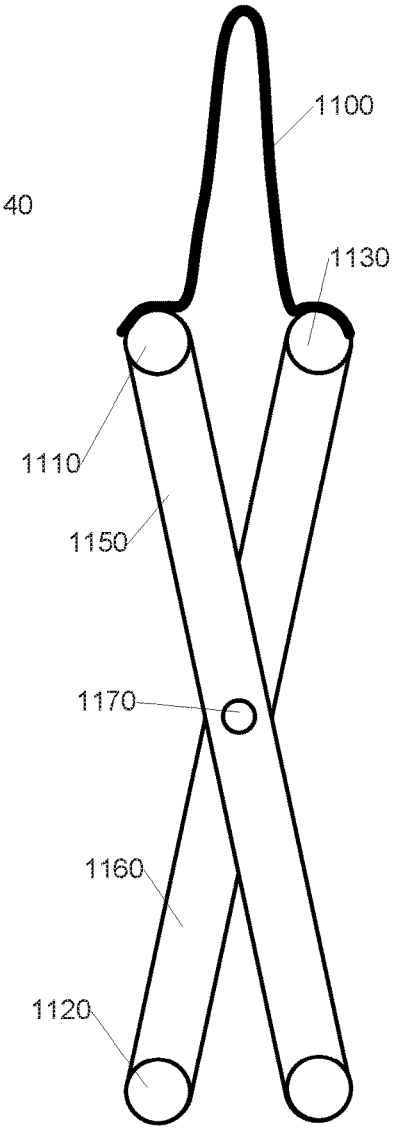

FIGS. 11A-11B are front view diagrams illustrating a collapsible wheelchair frame according to related art. In the illustrated embodiment of FIG. 11A, the wheelchair frame comprises a seat base 1100, a first lateral frame member 1110, a second lateral frame member 1120, a third lateral frame member 1130, a fourth lateral frame member 1140, a first cross frame member 1150 and a second cross frame member 1160. The first and second cross frame members 1150, 1160 are connected via a collapsible axis 1170 that allows the cross frame members 1150, 1160 to rotate with respect to each other about the collapsible axis 1170.

In the illustrated embodiment of FIG. 11B, the wheelchair frame is collapsed by rotating the first cross frame member 1150 and the second cross frame member 1160 with respect to each other about the collapsible axis 1170 resulting in a greater distance between the first lateral frame member 1110 and the second lateral frame member 1120, a closer distance between the first lateral frame member 1110 and the third lateral frame member 1130 and elevation of the seat base 1100.

Figure 12:
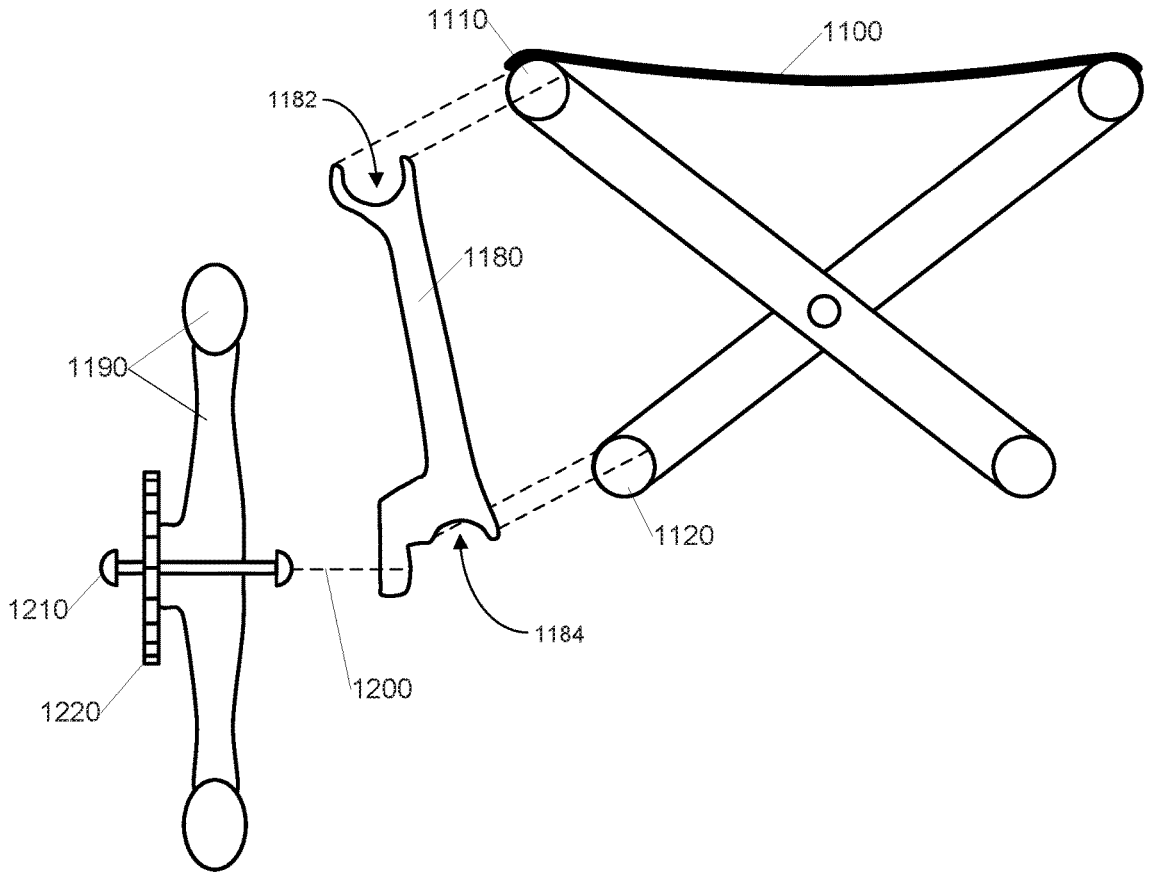
FIG. 12 is an expanded view diagram illustrating an example drive wheel and first brace according to an implementation of the present application.

FIG. 12 is an expanded view diagram illustrating an example drive wheel 1190 and first brace 1180 according to an implementation of the present application. In the illustrated embodiment, the first brace 1180 comprises a first brace upper recess 1182 and a first brace lower recess 1184. The first brace upper recess 1182 and first brace lower recess 1184 are configured to attach to the first lateral frame member 1110 and the second lateral frame member 1120, respectively. In one embodiment, the first brace lower recess 1184 is configured to release the second lateral frame member 1120 when the wheelchair is collapsed. In an alternative embodiment, the first brace upper recess 1182 is configured to release the first lateral frame member 1110 when the wheelchair is collapsed. In another alternative embodiment, both of the first brace lower recess 1184 and the first brace upper recess 1182 are configured to release the second lateral frame member 1120 and the first lateral frame member 1110, respectively, when the wheelchair is collapsed.

Also in the illustrated embodiment, the drive wheel 1190 (comprising both a perimeter tire and a wheel) rotates about the drive wheel axis of rotation 1200. A drive wheel axle 1210 is positioned along the drive wheel axis of rotation 1200 and extends through a drive wheel sprocket 1220 and the drive wheel 1190.

Figure 13:
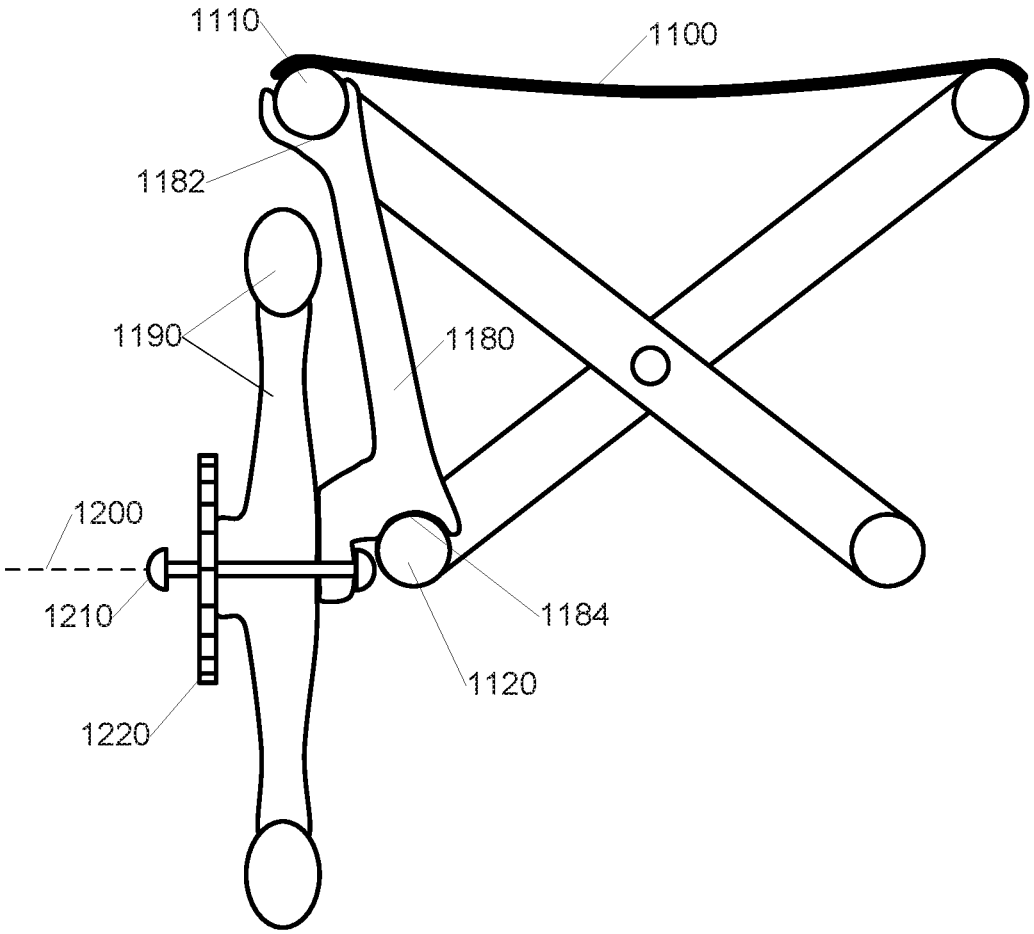
FIG. 13 is a front view diagram illustrating an example drive wheel connected to first brace of a wheelchair frame according to an implementation of the present application.

FIG. 13 is a front view diagram illustrating an example drive wheel 1190 connected to first brace 1180 of a wheelchair frame according to an implementation of the present application. In the illustrated embodiment, the drive wheel 1190 and the drive wheel sprocket 1220 rotate with respect to the wheelchair frame about the drive wheel axle 1210 that is positioned along the drive wheel axis of rotation 1200. The drive wheel axle 1210 extends through the drive wheel sprocket 1220, the drive wheel 1190 and the first brace 1180 in order to secure the drive wheel 1190 to the first lateral frame member 1110 and the second lateral frame member 1120 of the wheelchair frame. The first brace upper recess 1182 engages the first lateral frame member 1110 and the first brace lower recess 1184 engages the second lateral frame member 1120 when the wheelchair is not collapsed.

Figure 14:
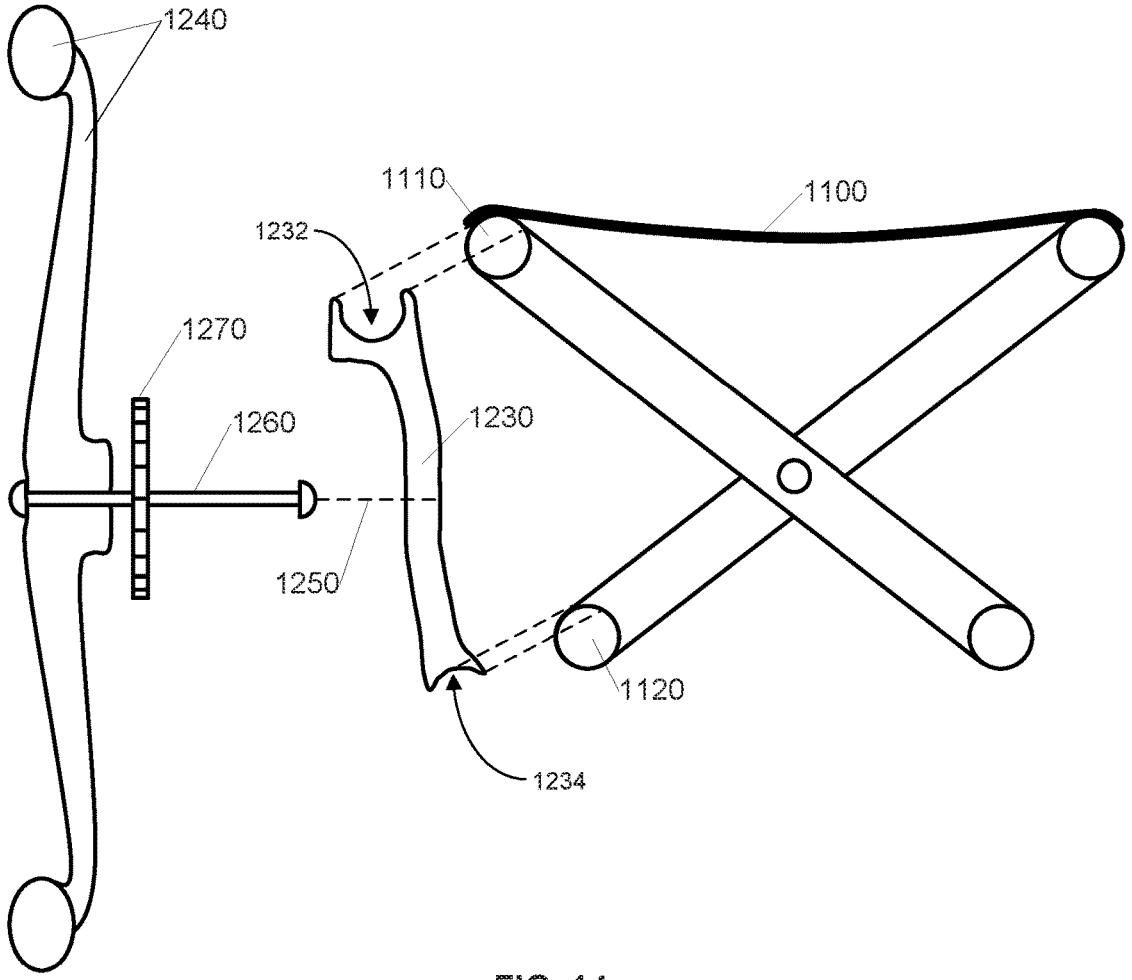
FIG. 14 is an expanded view diagram illustrating an example push rim and second brace according to an implementation of the present application.

FIG. 14 is an expanded view diagram illustrating an example push rim 1240 and second brace 1230 according to an implementation of the present application. In the illustrated embodiment, the second brace 1230 comprises a second brace upper recess 1232 and a second brace lower recess 1234. The second brace upper recess 1232 and second brace lower recess 1234 are configured to attach to the first lateral frame member 1110 and the second lateral frame member 1120, respectively. In one embodiment, the second brace lower recess 1234 is configured to release the second lateral frame member 1120 when the wheelchair is collapsed. In an alternative embodiment, the second brace upper recess 1232 is configured to release the first lateral frame member 1110 when the wheelchair is collapsed. In another alternative embodiment, both of the second brace lower recess 1234 and the second brace upper recess 1232 are configured to release the second lateral frame member 1120 and the first lateral frame member 1110, respectively, when the wheelchair is collapsed.

Also in the illustrated embodiment, the push rim 1240 rotates about the push rim axis of rotation 1250. A push rim axle 1260 is positioned along the push rim axis of rotation 1250 and extends through a push rim sprocket 1270 and the push rim 1240.

Figure 15:
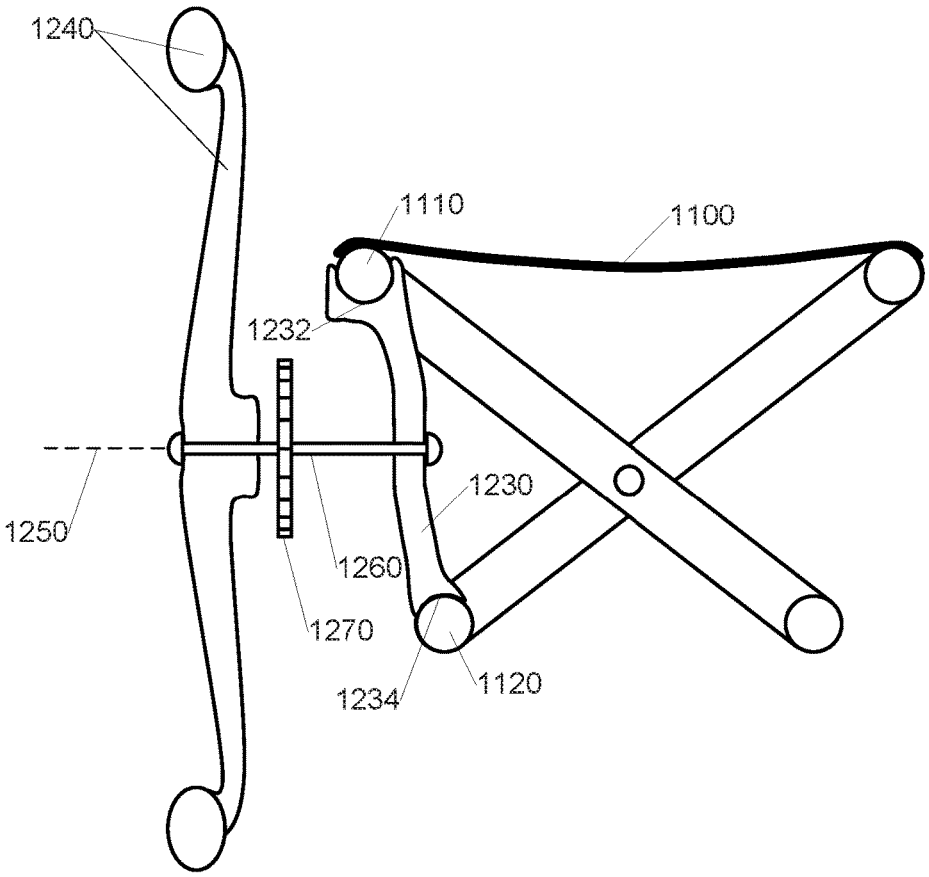
FIG. 15 is a front view diagram illustrating an example push rim and second brace connected to a wheelchair frame according to an implementation of the present application.

FIG. 15 is a front view diagram illustrating an example push rim 1240 and second brace 1230 connected to a wheelchair frame according to an implementation of the present application. In the illustrated embodiment, the push rim 1240 and the push rim sprocket 1270 rotate with respect to the wheelchair frame about the push rim axle 1260 that is positioned along the push rim axis of rotation 1250. The push rim axle 1260 extends through the push rim sprocket 1270, the push rim 1240 and the second brace 1230 in order to secure the push rim 1240 to the first lateral frame member 1110 and the second lateral frame member 1120 of the wheelchair frame. The second brace upper recess 1232 engages the first lateral frame member 1110 and the second brace lower recess 1234 engages the second lateral frame member 1120 when the wheelchair is not collapsed.

Figure 16:
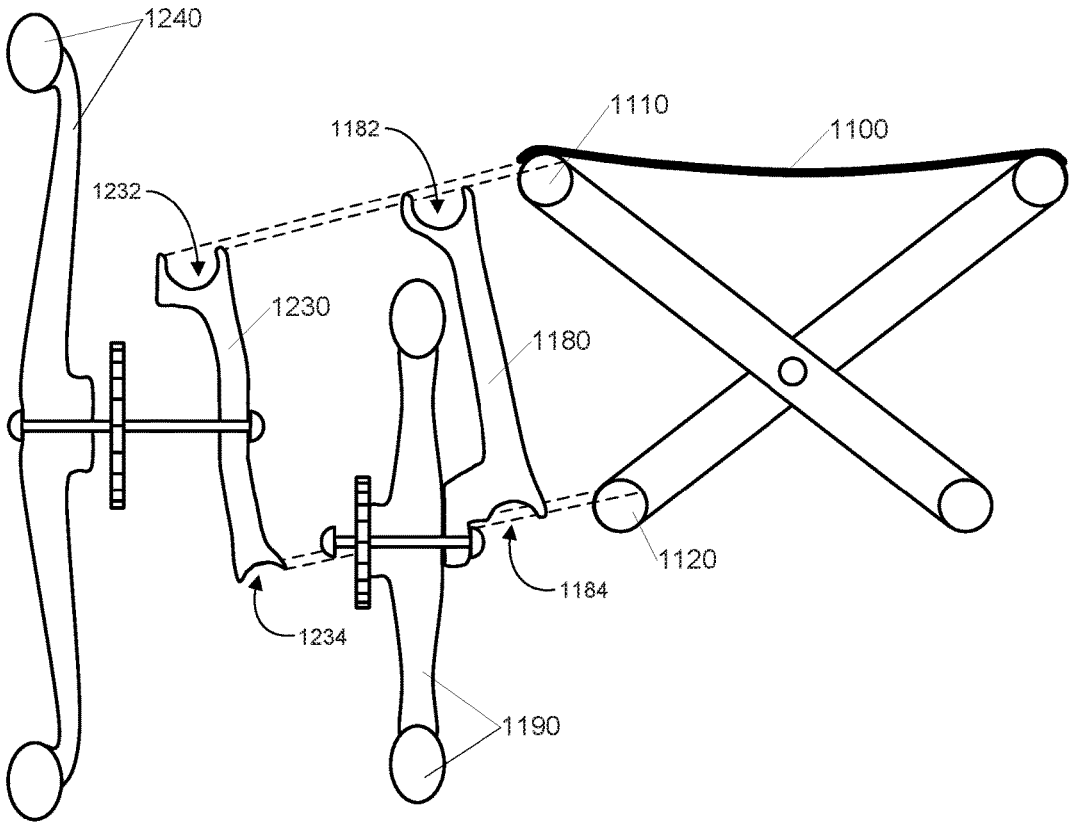
FIG. 16 is an expanded view diagram illustrating an example drive wheel and first brace combined with an example push rim and second brace according to an implementation of the present application.

FIG. 16 is an expanded view diagram illustrating an example drive wheel 1190 and first brace 1180 combined with an example push rim 1240 and second brace 1230 according to an implementation of the present application. In the illustrated embodiment, first brace upper recess 1182 and the second brace upper recess 1232 are configured to engage the first lateral frame member 1110 and the first brace lower recess 1184 and the second brace lower recess 1234 are configured to engage the second lateral frame member 1120.

Figure 17:
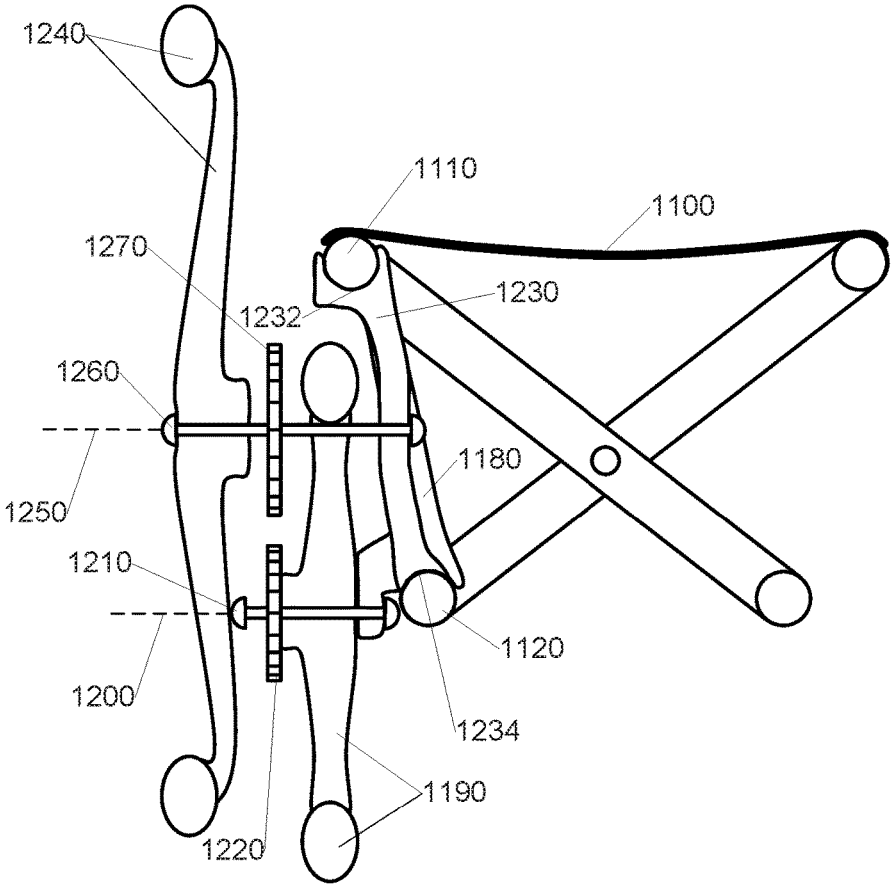
FIG. 17 is a front view diagram illustrating an example drive wheel and first brace combined with an example push rim and second brace and connected to a wheelchair frame according to an implementation of the present application.

FIG. 17 is a front view diagram illustrating an example drive wheel 1190 and first brace 1180 combined with an example push rim 1240 and second brace 1230 and connected to the first lateral frame member 1110 and the second lateral frame member 1120 of a wheelchair frame according to an implementation of the present application. In the illustrated embodiment, the drive wheel 1190 rotates with respect to the wheelchair frame about the drive wheel axis 1200. The drive wheel axle 1210 extends along the drive wheel axis 1200 through the drive wheel 1190 and the drive wheel sprocket 1220 and through a lower portion of the first brace 1180.

Also in the illustrated embodiment, the push rim 1240 rotates with respect to the wheelchair frame about the push rim axis 1250. The push rim axle 1260 extends along the push rim axis 1250 through the push rim 1240 and the push rim sprocket 1270 and through a middle portion of the second brace 1230.

Also in the illustrated embodiment, first brace upper recess 1182 and the second brace upper recess 1232 each engage the first lateral frame member 1110 and the first brace lower recess 1184 and the second brace lower recess 1234 each engage the second lateral frame member 1120. When the first brace upper recess 1182 and the second brace upper recess 1232 are both engaged with the first lateral frame member 1110 and the first brace lower recess 1184 and the second brace lower recess 1234 are both engaged with the second lateral frame member 1120, the wheelchair is not collapsed.

Figure 18:
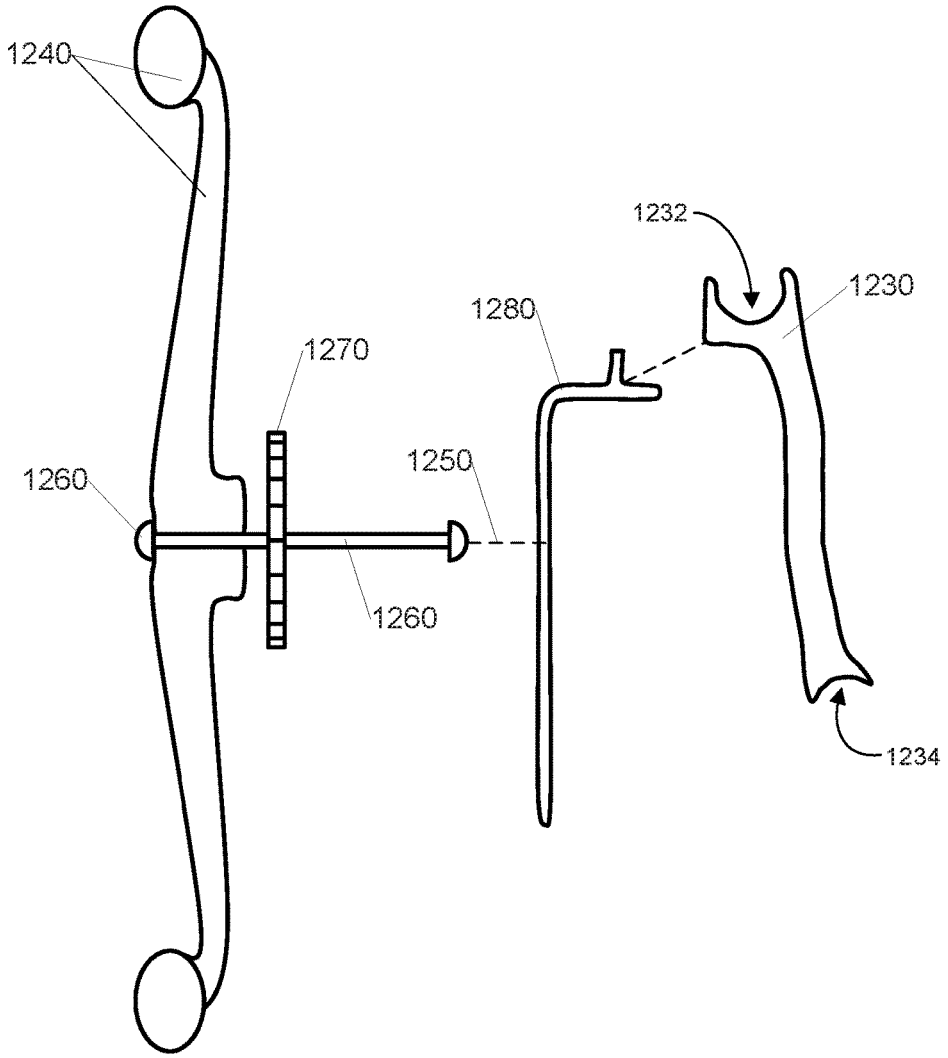
FIG. 18 is an expanded view diagram illustrating an example push rim and drive chain guard and second brace according to an implementation of the present application.

FIG. 18 is an expanded view diagram illustrating an example push rim 1240 and drive chain guard 1280 and second brace 1230 according to an implementation of the present application. In the illustrated embodiment, the drive train guard 1280 is configured to engage a portion of the second brace 1230 proximal the second brace upper recess 1232. In one embodiment, the drive train guard 1280 is configured to engage the second brace 1230 and carry at least a portion of the downward force that would otherwise be carried by the second brace 1230. Any force the drive train guard 1280 receives from the second brace 1230 is delivered to the drive wheel 1190 by way of the drive wheel axle 1210. The push rim axle 1260 is configured to extend through holes in each of the push rim 1240 and the push rim sprocket 1270 and the drive chain guard 1280 and through a hole in the middle portion of the second brace 1230 to secure the push rim 1240 to the frame of the collapsible wheelchair. The drive chain guard 1280 advantageously separates and protects the user from the moving parts of the drive train 1290 during operation of the manual wheelchair.

Figure 19:
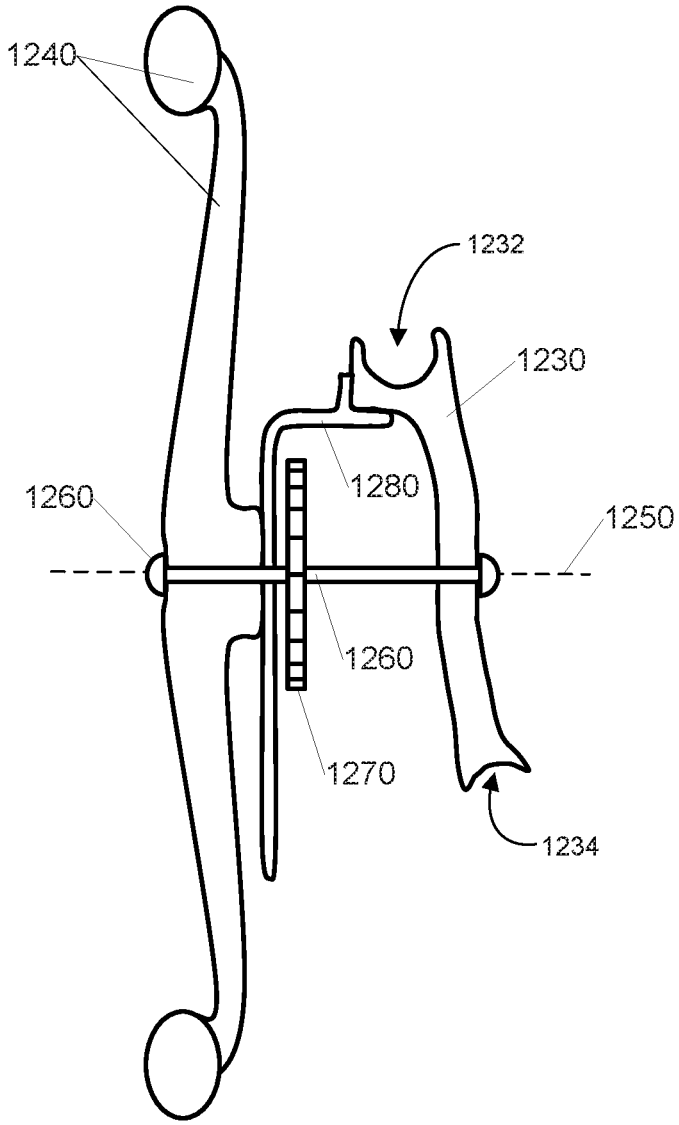
FIG. 19 a front view diagram illustrating an example push rim and drive chain guard and second brace connected to a wheelchair frame according to an implementation of the present application.

FIG. 19 a front view diagram illustrating an example push rim 1240 and drive chain guard 1280 and second brace 1230 connected to a wheelchair frame according to an implementation of the present application. In the illustrated embodiment, the push rim 1240 rotates about the push rim axis 1250 and is secured to the second brace 1230 via the push rim axle 1260, which extends along the push rim axis 1250 through the push rim 1240, the drive train guard 1280, the push rim sprocket 1270 and the second brace 1230.

Figure 20:
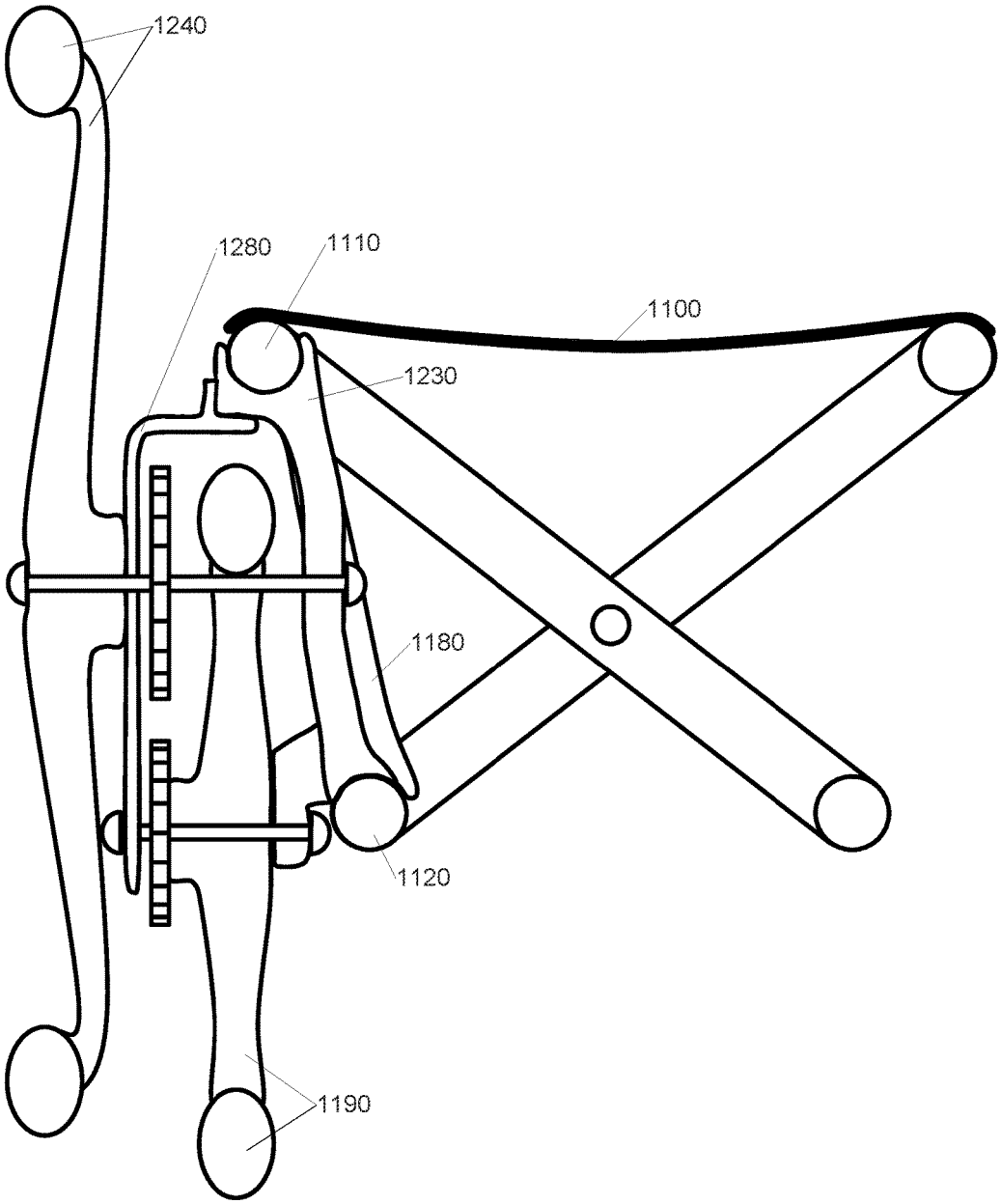
FIG. 20 is a front view diagram illustrating an example drive wheel and first brace combined with an example push rim and drive chain guard and second brace and connected to a wheelchair frame according to an implementation of the present application.

FIG. 20 is a front view diagram illustrating an example drive wheel 1190 and first brace 1180 combined with an example push rim 1240 and drive chain guard 1280 and second brace 1230. The first brace 1180 and the second brace 1230 are each connected to the first lateral member 1110 and the second lateral member 1120 of a wheelchair frame according to an implementation of the present application.

In the illustrated embodiment, the drive train guard 1280 is configured to engage the second brace 1230 proximal to the second brace upper recess. The drive train guard 1280 also includes two or more through holes to allow at least the push rim axle 1260 and the drive wheel axle 1210 to pass through the drive train guard 1280. The drive train guard 1280 may or may not be configured to deliver a portion of the downward force that would otherwise be carried by the second brace 1230 to the drive wheel axle 1210. The drive wheel axle 1210 is configured to extend through holes in each of the drive wheel 1190 and the drive wheel sprocket 1220 and the drive chain guard 1280 and through a hole in the first brace 1180 proximal to the second lateral frame member 1120 when the wheelchair is not collapsed. The drive wheel axle 1210 thereby secures the drive wheel 1190 to the frame of the collapsible wheelchair. The drive chain guard 1280 advantageously separates and protects the user from the moving parts of the drive train 1290 during operation of the manual wheelchair.

Although the illustrated embodiment shows the drive train 1290 components between the push rim 1240 and the drive wheel 1190, in an alternative embodiment, the push rim 1240, the drive train 1290 and the drive wheel 1190 can be in any order. For example, in one embodiment, the push rim 1240 is positioned on the outside and the drive wheel 1190 is positioned between the push rim 1240 and the drive train 1290. It is preferred that the drive train guard 1280 separate the operator from drive train 1290 and the drive wheel 1190 in order to protect the operator from those moving parts during operation of the manual wheelchair.

Figure 21:
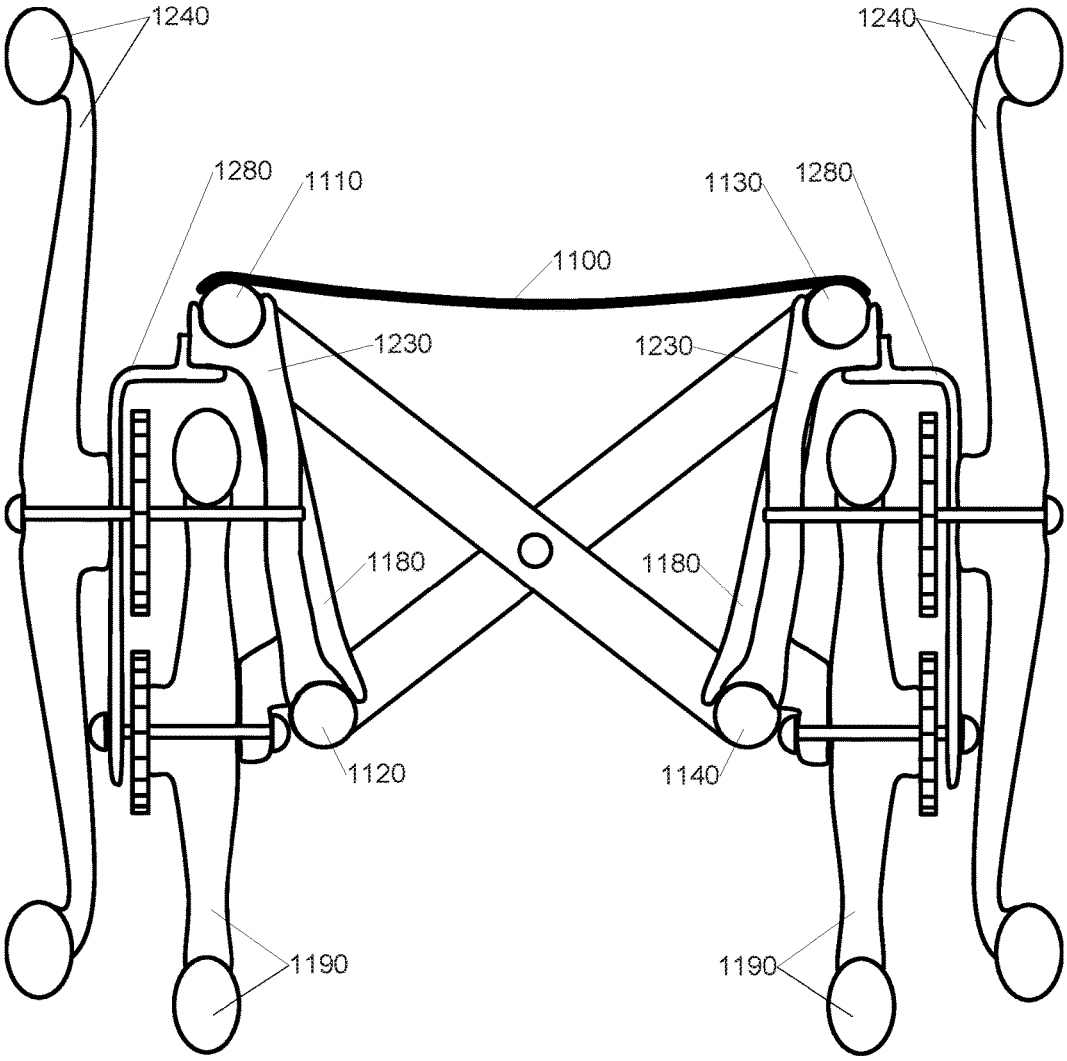
FIGS. 21-23 are front view diagrams illustrating an example collapsible wheelchair having first and second braces that release the first lateral member according to an implementation of the present application.
Figure 22:
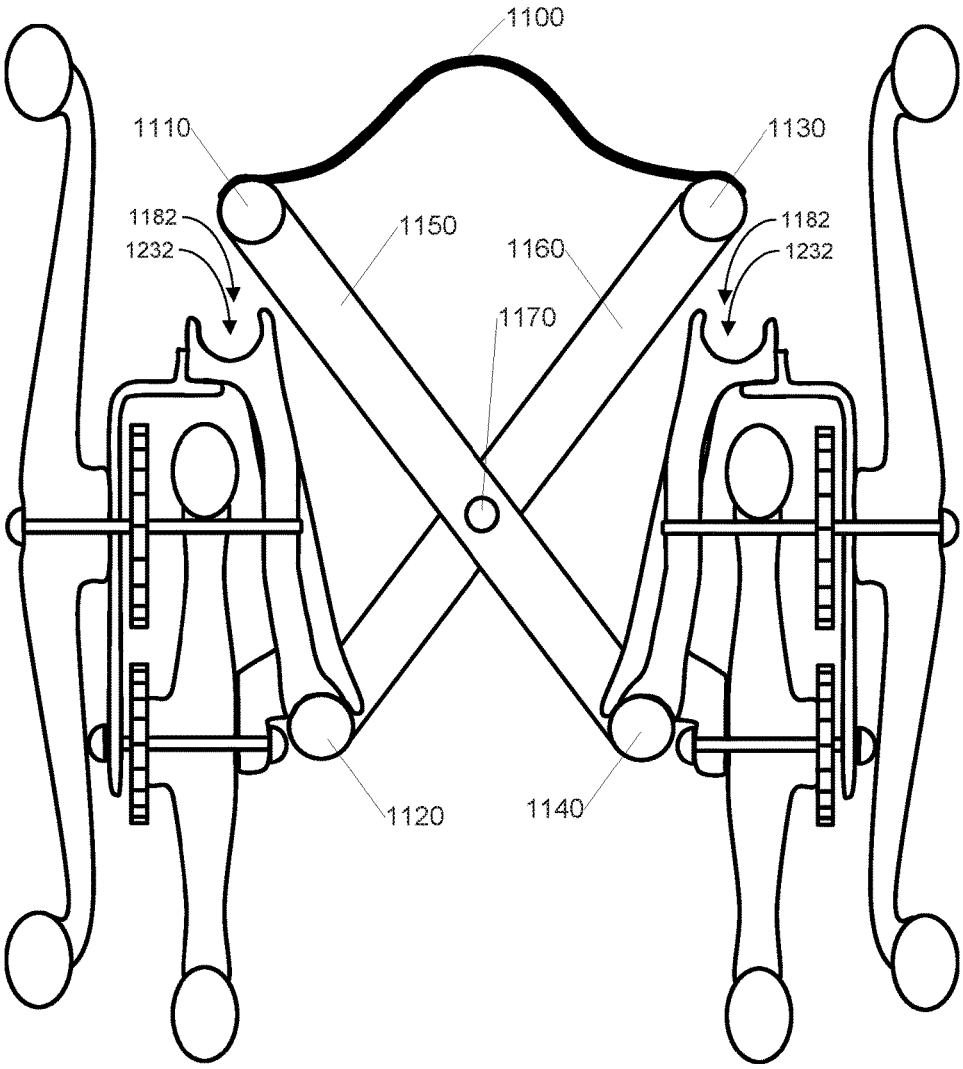
Figure 23:
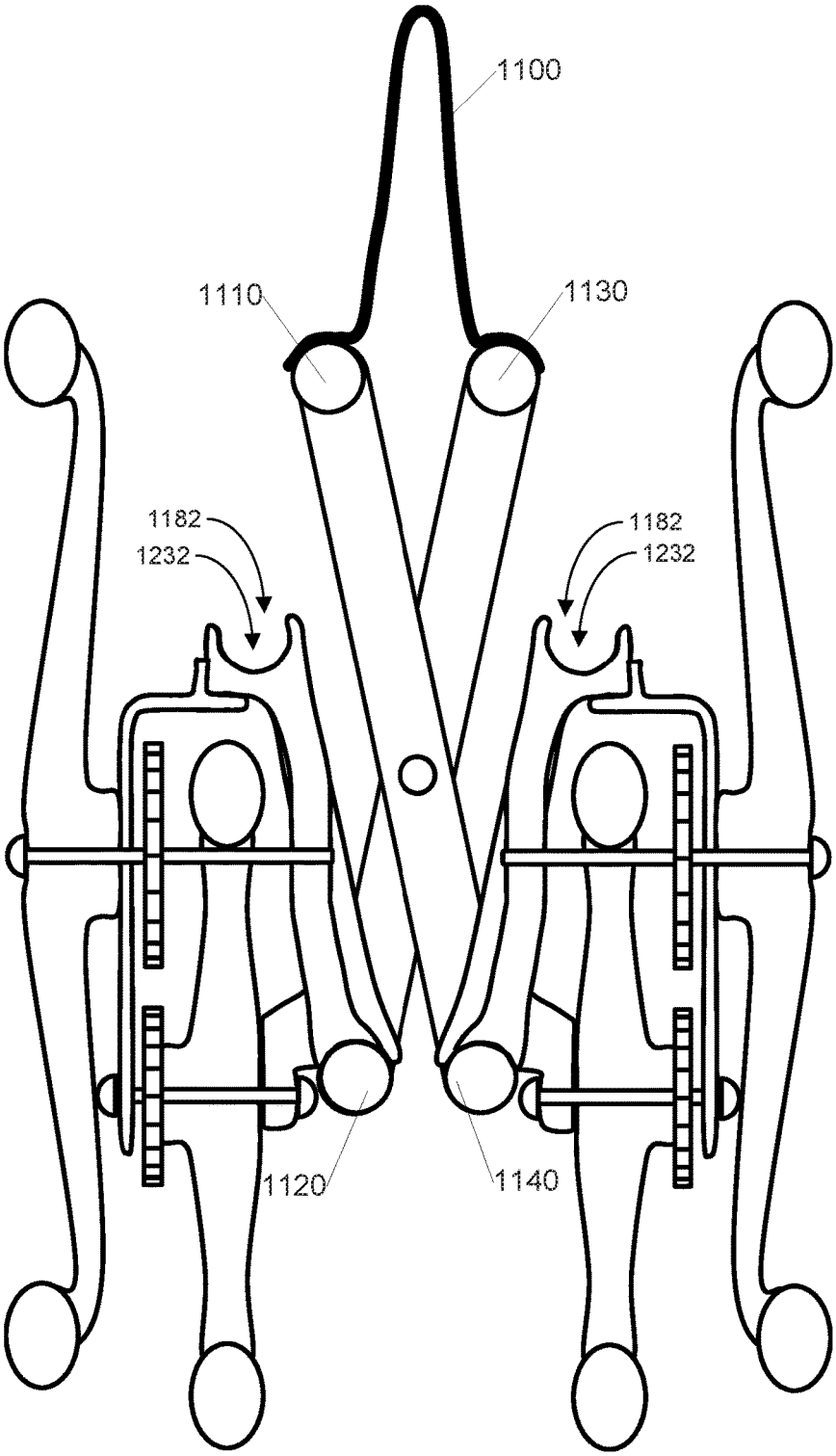

FIGS. 21-23 are front view diagrams illustrating an example collapsible wheelchair having first and second braces 1180, 1230 that release the first lateral member 1110 according to an implementation of the present application. In the illustrated embodiment, FIG. 21 shows the collapsible wheelchair with mirror parts on both sides of the wheelchair and the first and second braces 1180, 1230 are engaged with the first and second lateral members 1110, 1120. FIG. 22 shows the collapsible wheelchair after the first and second braces 1180, 1230 have released the first lateral member 1110 and the first and second cross frame members 1150 and 1160 have rotated about the collapsible axis 1170 to increase the distance between the first lateral frame member 1110 and the second lateral frame member 1120. FIG. 23 shows the collapsible wheelchair after the first and second cross frame members 1150 and 1160 have rotated further about the collapsible axis 1170 to place the manual wheelchair into the collapsed configuration. Notably, the first brace upper recess 1182 and the second brace upper recess 1232 are not engaged with the first lateral frame member 1110 when the manual wheelchair is in the collapsed configuration as shown.

Figure 24:
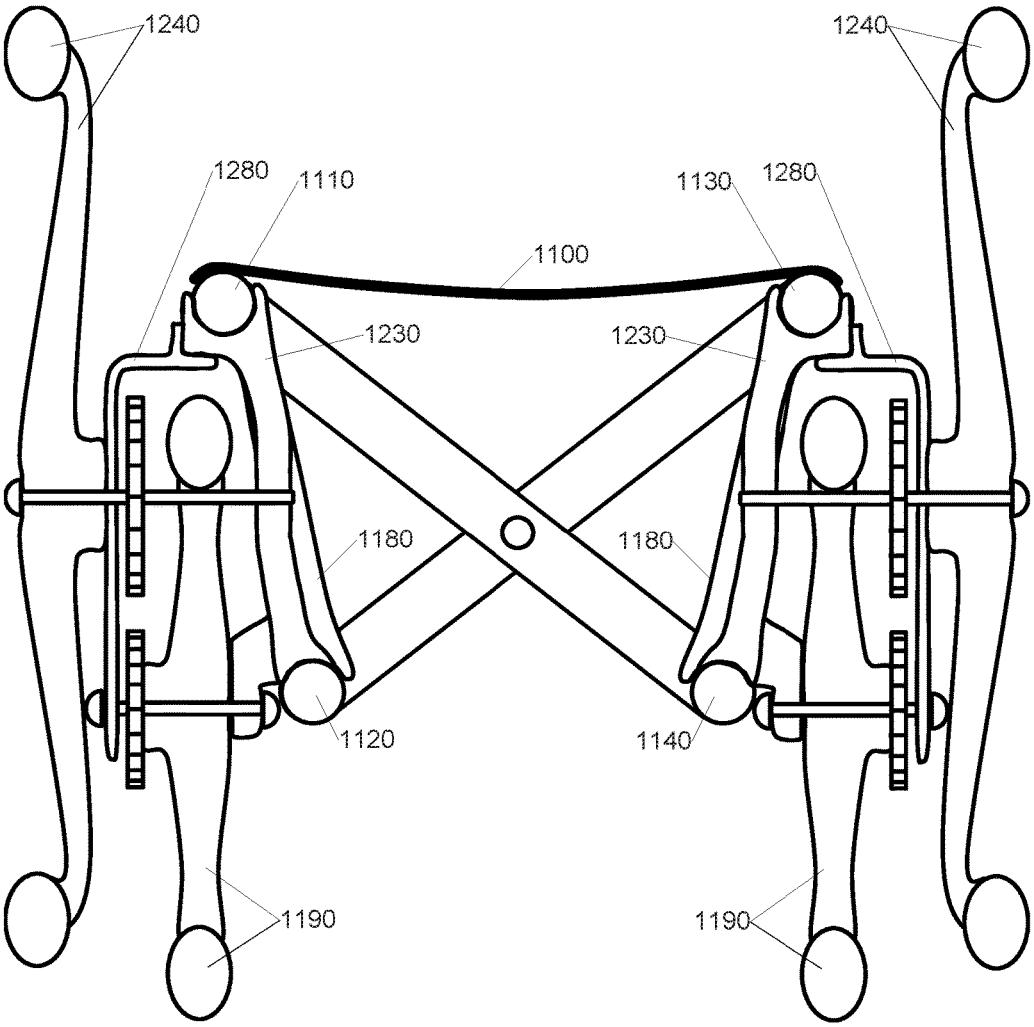
FIGS. 24-26 are front view diagrams illustrating an example collapsible wheelchair having first and second braces that release the second lateral member according to an implementation of the present application.
Figure 25:
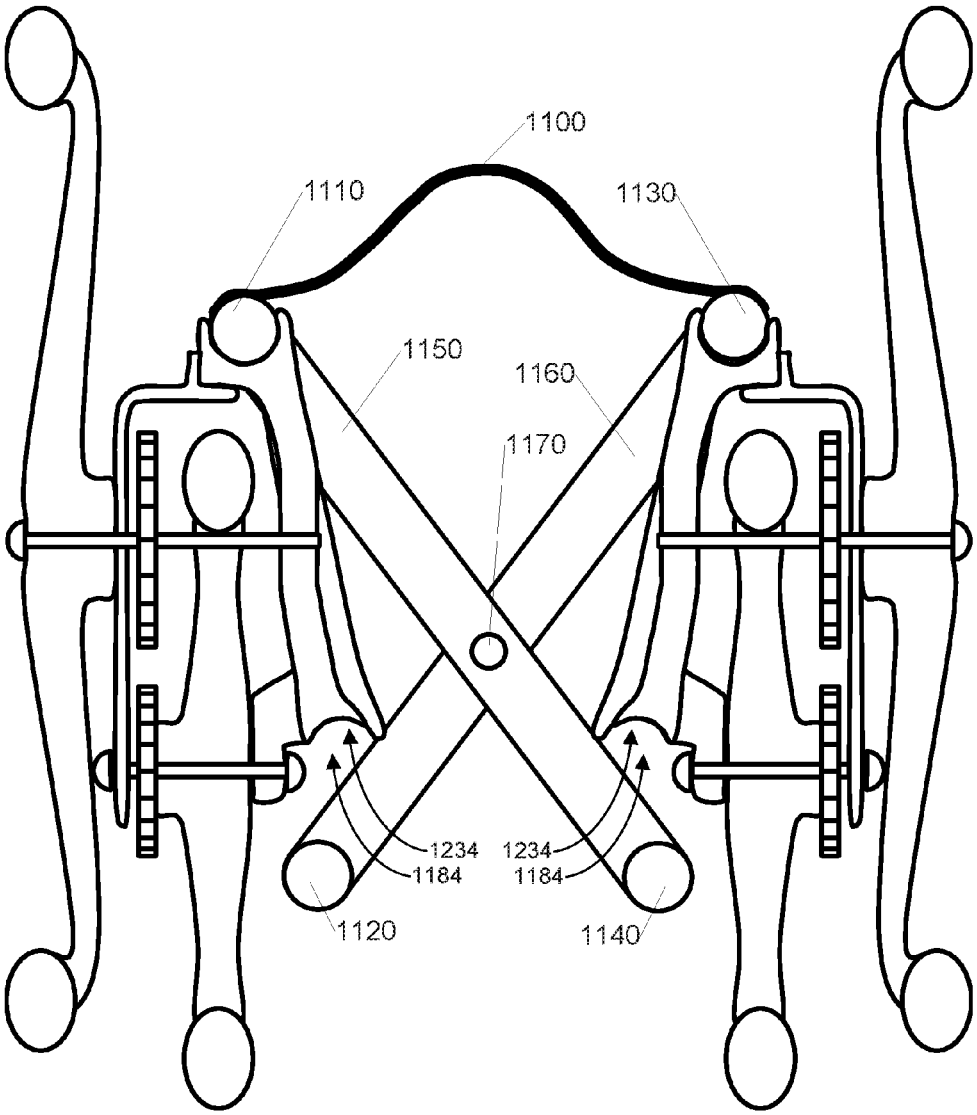
Figure 26:
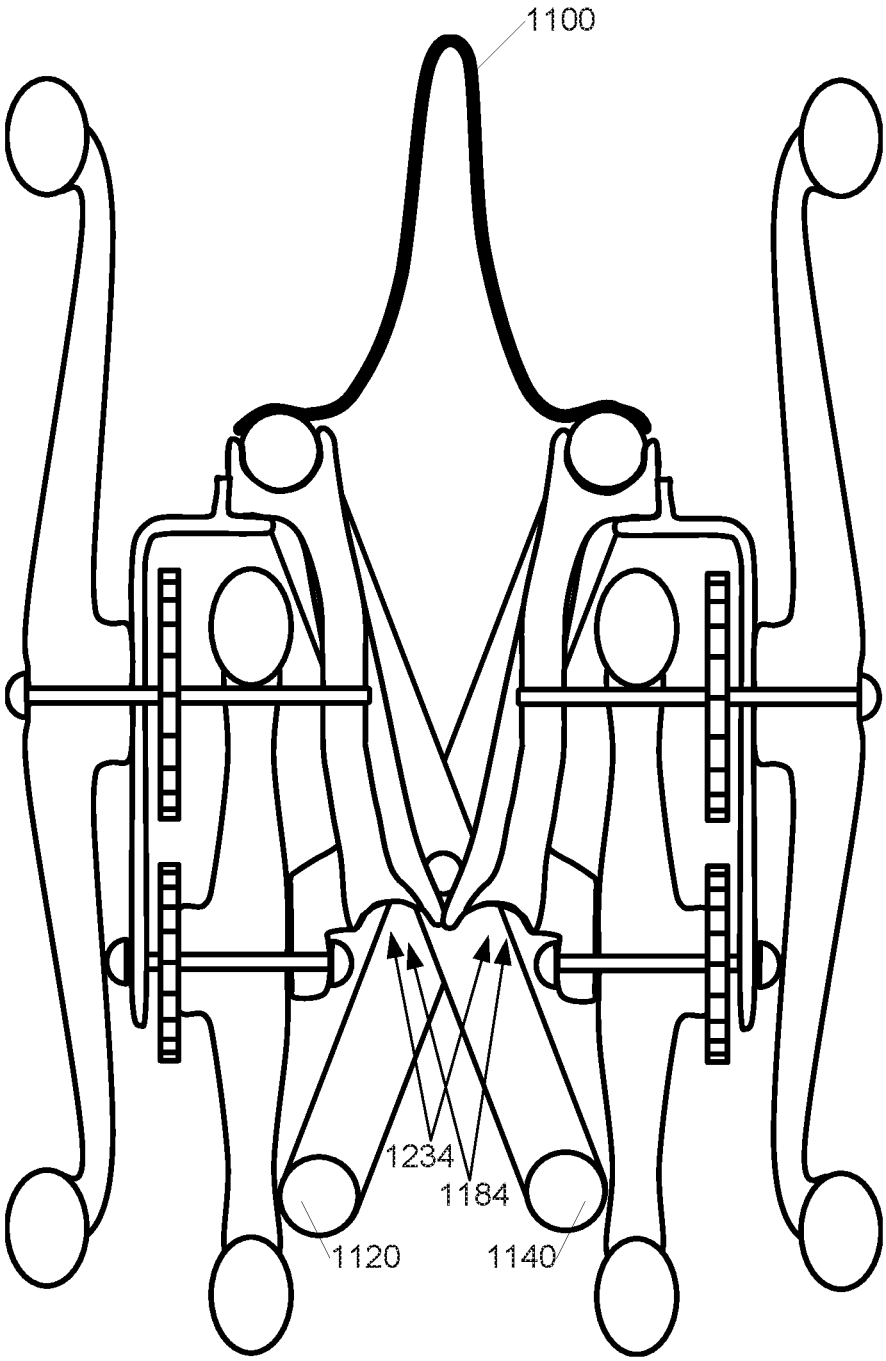

FIGS. 24-26 are front view diagrams illustrating an example collapsible wheelchair having first and second braces 1180, 1230 that release the second lateral member 1120 according to an implementation of the present application. In the illustrated embodiment, FIG. 24 shows the collapsible wheelchair with mirror parts on both sides of the wheelchair and the first and second braces 1180, 1230 are engaged with the first and second lateral members 1110, 1120. FIG. 25 shows the collapsible wheelchair after the first and second braces 1180, 1230 have released the second lateral member 1120 and the first and second cross frame members 1150 and 1160 have rotated about the collapsible axis 1170 to increase the distance between the first lateral frame member 1110 and the second lateral frame member 1120. FIG. 26 shows the collapsible wheelchair after the first and second cross frame members 1150 and 1160 have rotated further about the collapsible axis 1170 to place the manual wheelchair into the collapsed configuration. Notably, the first brace lower recess 1184 and the second brace lower recess 1234 are not engaged with the second lateral frame member 1120 when the manual wheelchair is in the collapsed configuration as shown.

Figure 27:
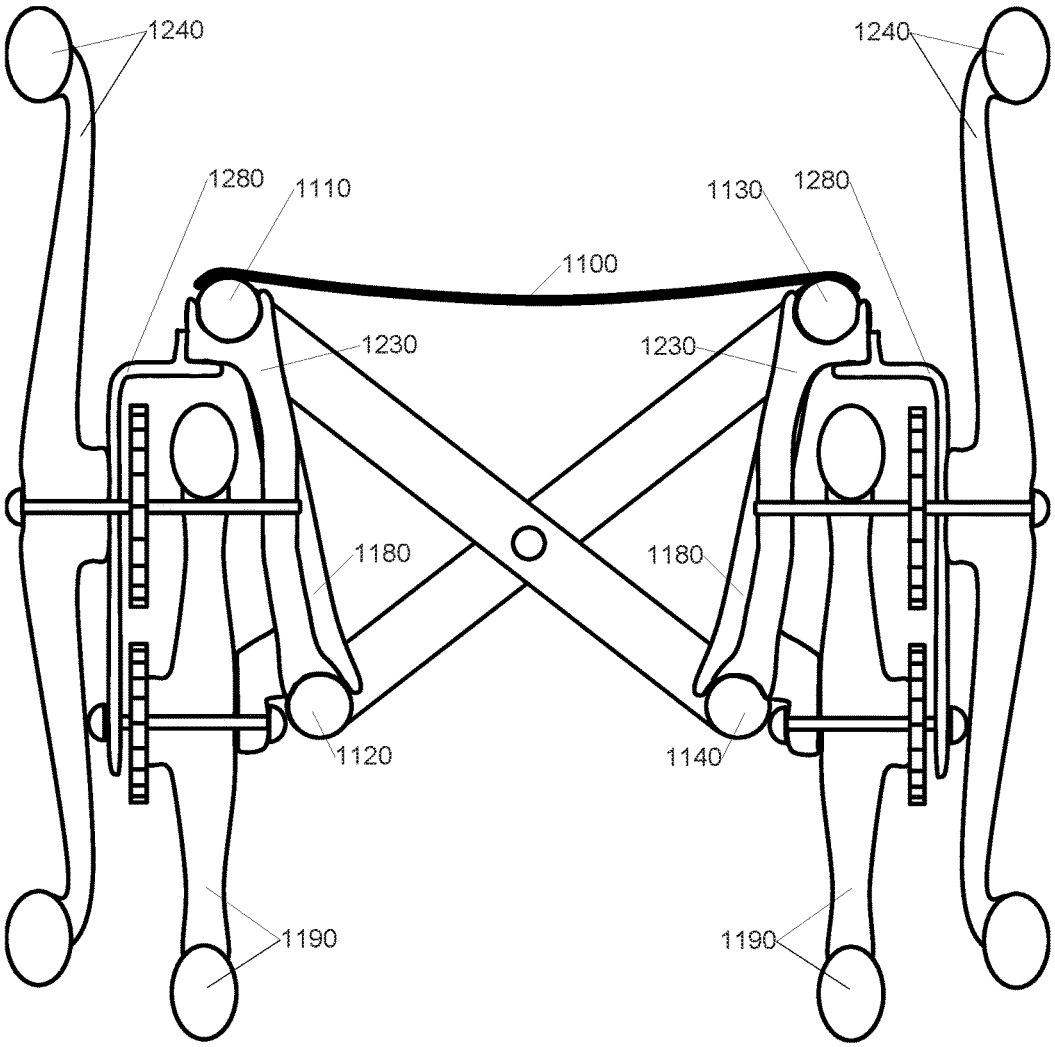
FIGS. 27-29 are front view diagrams illustrating an example collapsible wheelchair having first and second braces that release the first and second lateral members according to an implementation of the present application.
Figure 28:
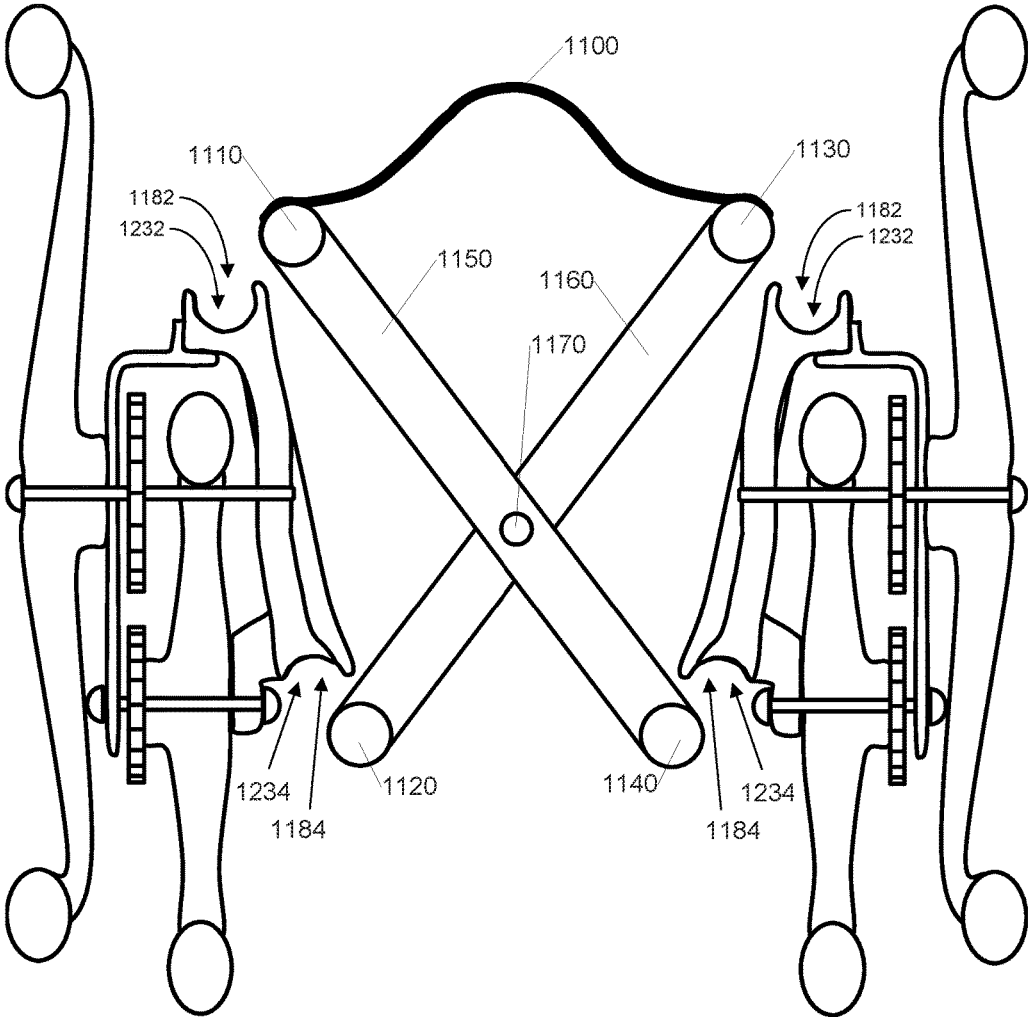
Figure 29:
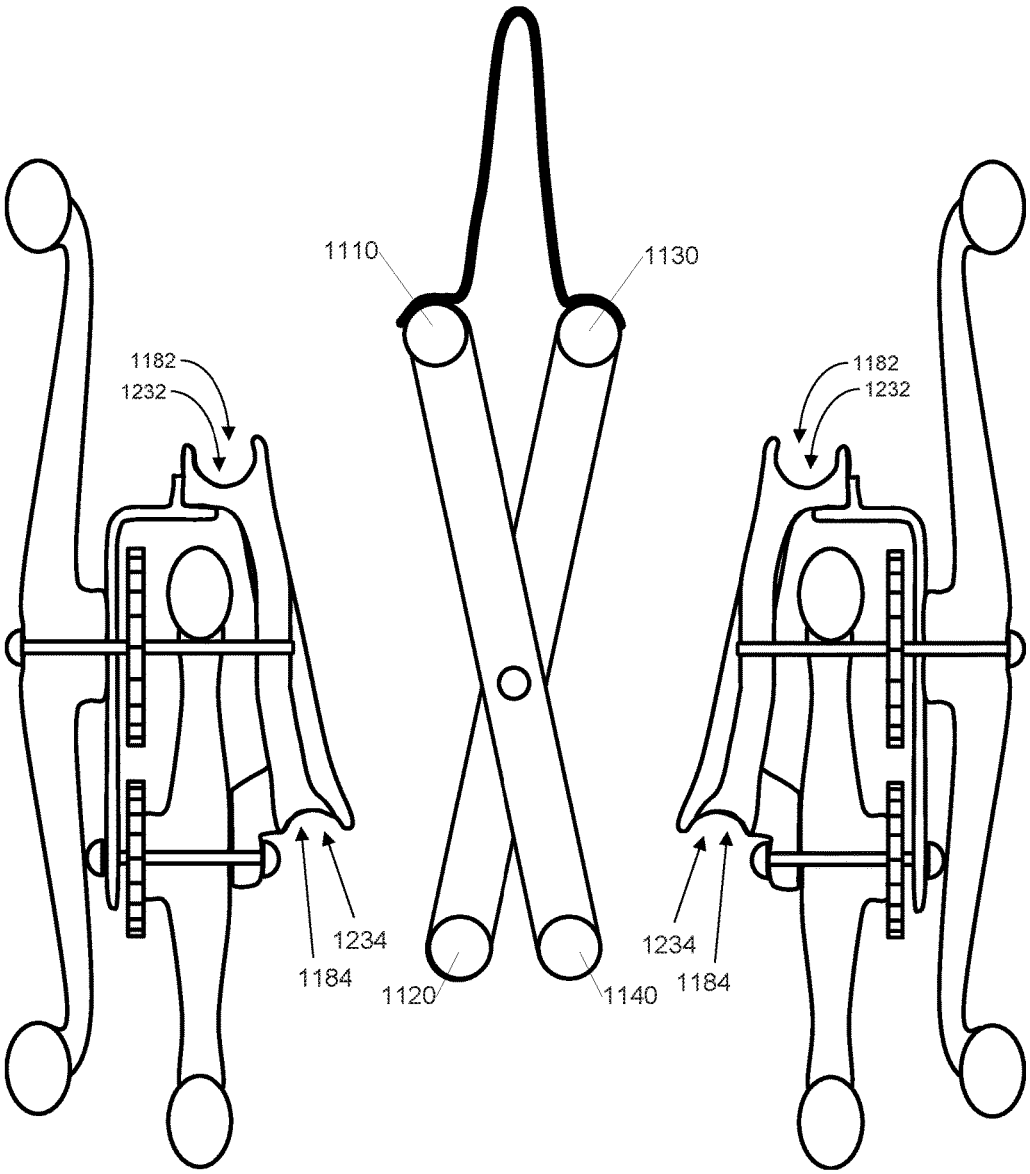

FIGS. 27-29 are front view diagrams illustrating an example collapsible wheelchair having first and second braces 1180, 1230 that release the first and second lateral members 1110, 1120 according to an implementation of the present application. In the illustrated embodiment, FIG. 27 shows the collapsible wheelchair with mirror parts on both sides of the wheelchair and the first and second braces 1180, 1230 are engaged with the first and second lateral members 1110, 1120. FIG. 28 shows the collapsible wheelchair after the first and second braces 1180, 1230 have released the first lateral member 1110 and the second lateral member 1120 and the first and second cross frame members 1150 and 1160 have rotated about the collapsible axis 1170 to increase the distance between the first lateral frame member 1110 and the second lateral frame member 1120. In FIG. 28, it is clear that the collapsible wheelchair separates into three separate portions after the first and second lateral members 1110, 1120 have been released by the first and second braces 1180, 1230. FIG. 29 shows the collapsible wheelchair after the first and second cross frame members 1150 and 1160 have rotated further about the collapsible axis 1170 to further compress the cross frame member section of the collapsible wheelchair. Notably, the first and second braces upper recesses 1182, 1232 and the first and second braces lower recess 1184, 1234 are not engaged with the first and second lateral frame members 1110, 1120 when the manual wheelchair is in the collapsed configuration as shown.

Figure 30:
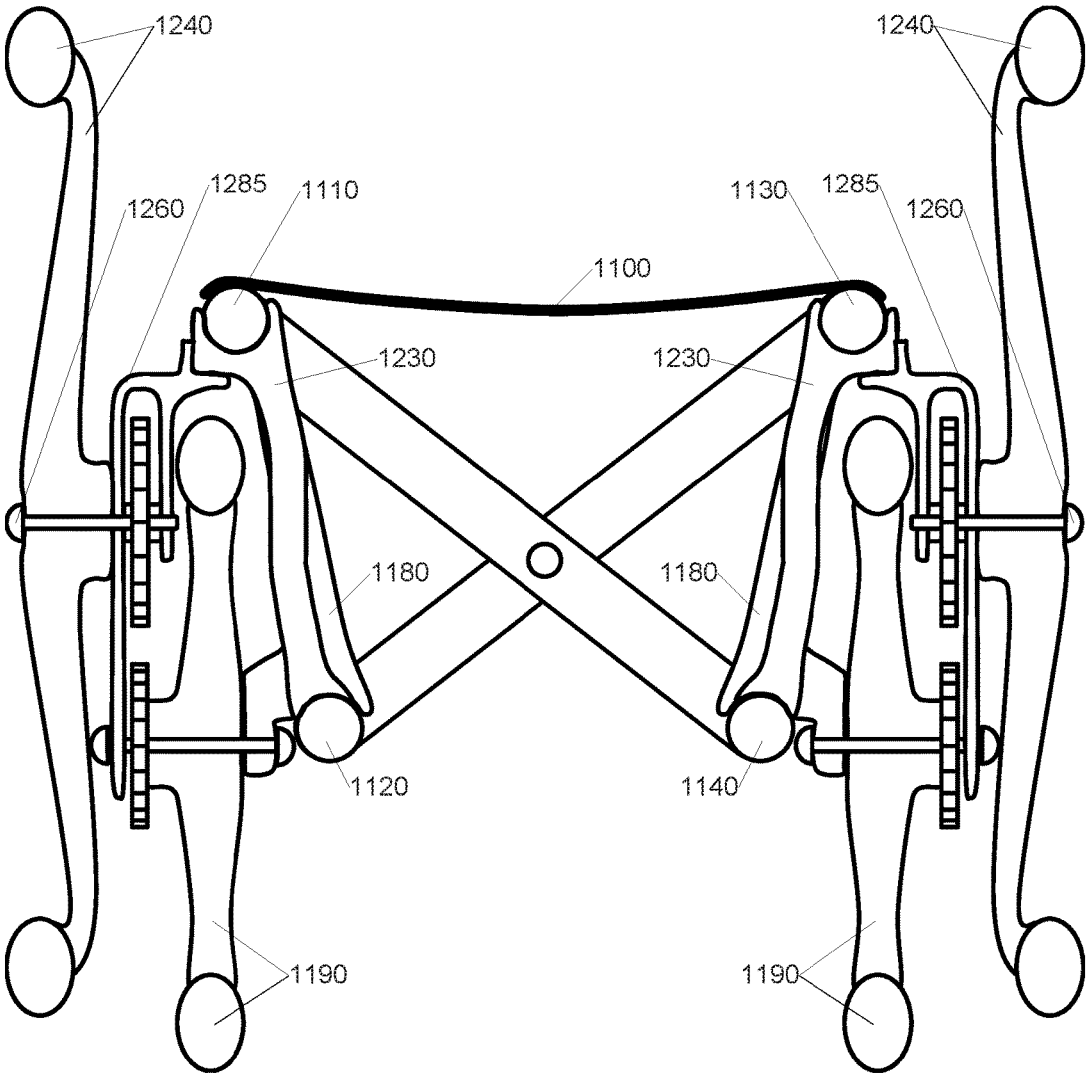
FIG. 30 is a front view diagram illustrating an example collapsible wheelchair having a drive train guard fork according to an implementation of the present application.

FIG. 30 is a front view diagram illustrating an example collapsible wheelchair having a drive train guard fork 1285 according to an implementation of the present application. In the illustrated embodiment, the fork 1285 includes an upper section that is configured to engage the second brace 1230. The fork 1285 also includes two extensions that extend down from the upper section on either side of the drive wheel sprocket 1220. A first extension of the fork 1285 extends down on a first side of the drive wheel sprocket 1220 that is adjacent to the push rim 1240. A second extension of the fork 1285 extends down on a second side of the drive wheel sprocket 1220 adjacent to the drive wheel 1190. Accordingly, the first extension of the fork 1285 functions at least in part as a drive train guard and the overall fork 1285 functions at least in part to translate a portion of the weight carried by the manual wheelchair from the first later member 1110 to the drive wheel 1190 via the drive wheel axle 1210.

The second extension of the fork 1285 additionally has a through hole aligned with the push rim axis of rotation 1250 to allow the push rim axle 1260 to extend through the push rim 1240, the first extension of the fork 1285, the push rim sprocket 1270 and the second extension of the fork 1285. Advantageously, the push rim axle can be secured on a first end to an outer surface of the push rim 1240 and can also be secure on a second end to an inner surface of the second extension of the fork 1285. Additionally, coupling the push rim axle 1260 to the push rim 1240 and the fork 1285 allows the push rim 1240 to be located in a variety of positions with respect to the drive wheel 1190 without interference with the operation of the drive wheel 1190.

Figure 31:
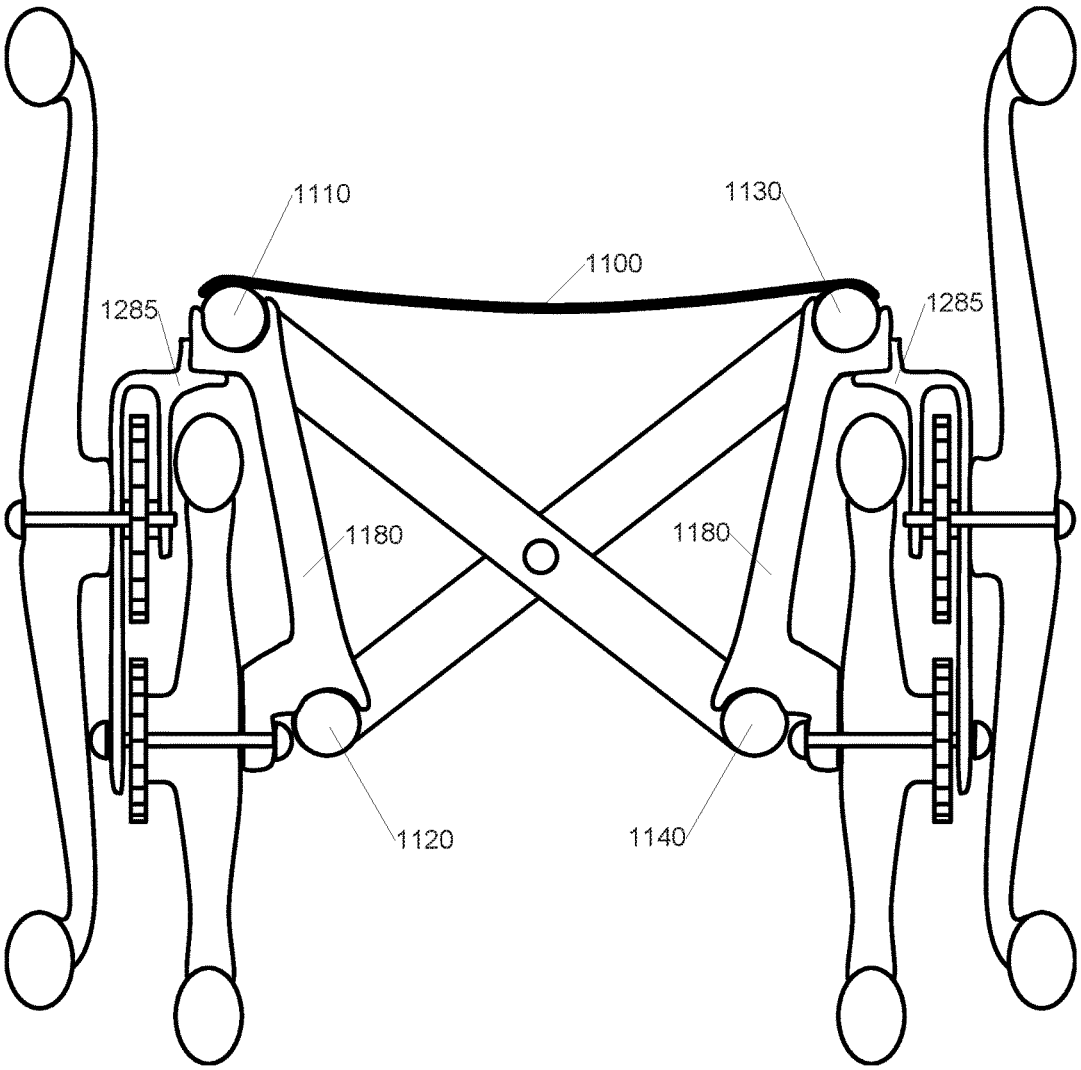
FIG. 31 is a front view diagram illustrating an example collapsible wheelchair having a drive train guard fork and a single brace according to an implementation of the present application.

In one embodiment, the collapsible wheelchair configured with a fork 1285 may eliminate one of the first or second braces 1180, 1230. FIG. 31 is a front view diagram illustrating an example collapsible wheelchair having a drive train guard fork 1285 and a single brace 1180 according to an implementation of the present application.

Figure 32:
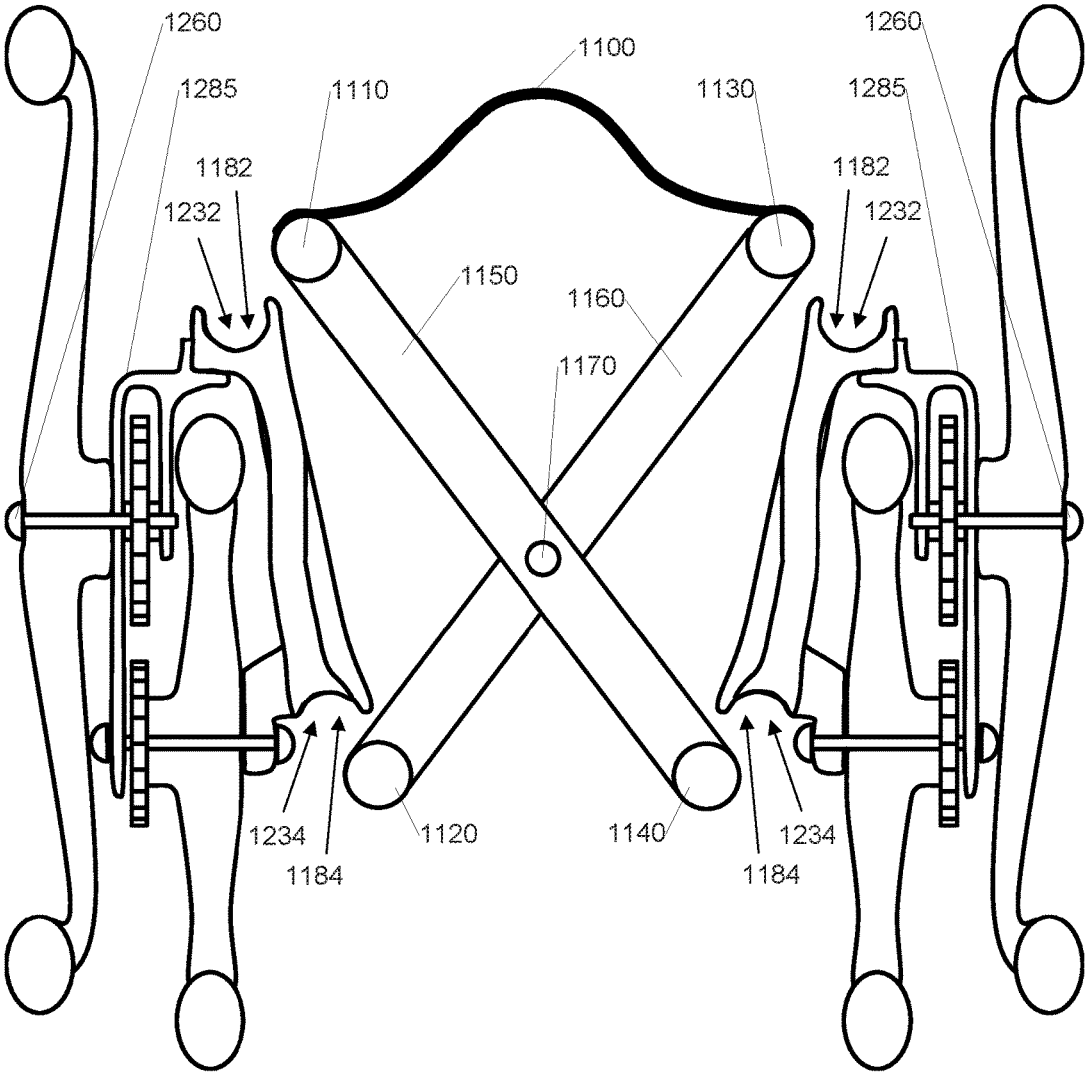
FIGS. 32-33 are front view diagrams illustrating an example collapsible wheelchair having first and second braces that release the first and second lateral members according to the implementation of FIG. 30.
Figure 33:
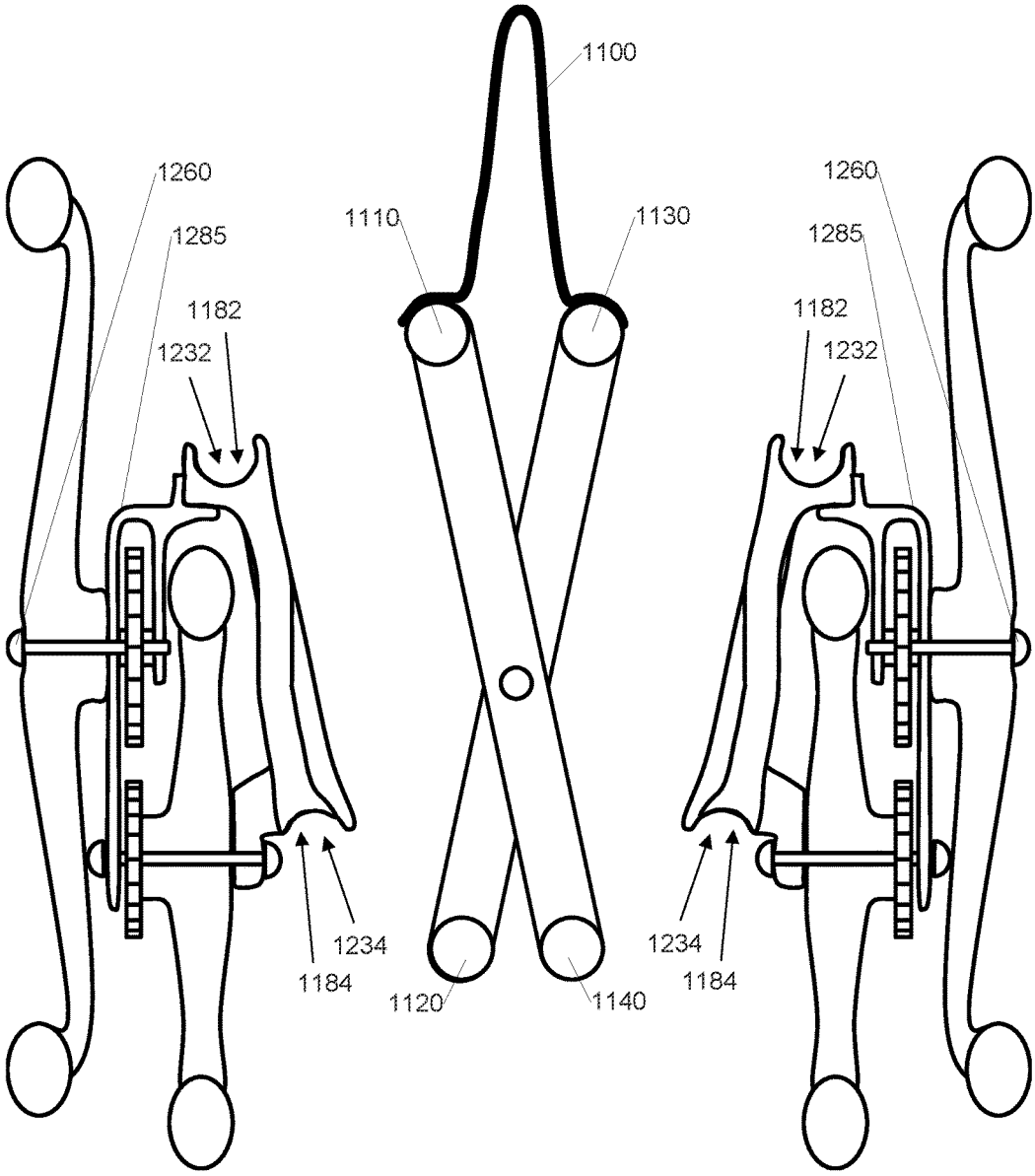

FIGS. 32-33 are front view diagrams illustrating an example collapsible wheelchair having a drive train guard fork 1285 and first and second braces 1180, 1230 that release the first and second lateral members 1110, 1120 according to the implementation of FIG. 30, which shows the collapsible wheelchair with mirror parts on both sides of the wheelchair and the first and second braces 1180, 1230 are engaged with the first and second lateral members 1110, 1120. FIG. 32 shows the collapsible wheelchair after the first and second braces 1180, 1230 have released the first lateral member 1110 and the second lateral member 1120 and the first and second cross frame members 1150 and 1160 have rotated about the collapsible axis 1170 to increase the distance between the first lateral frame member 1110 and the second lateral frame member 1120. In FIG. 32, it is clear that the collapsible wheelchair separates into three separate portions after the first and second lateral members 1110, 1120 have been released by the first and second braces 1180, 1230. FIG. 33 shows the collapsible wheelchair after the first and second cross frame members 1150 and 1160 have rotated further about the collapsible axis 1170 to further compress the cross frame member section of the collapsible wheelchair. Notably, the first and second braces upper recesses 1182, 1232 and the first and second braces lower recess 1184, 1234 are not engaged with the first and second lateral frame members 1110, 1120 when the manual wheelchair is in the collapsed configuration as shown.

Figure 34:
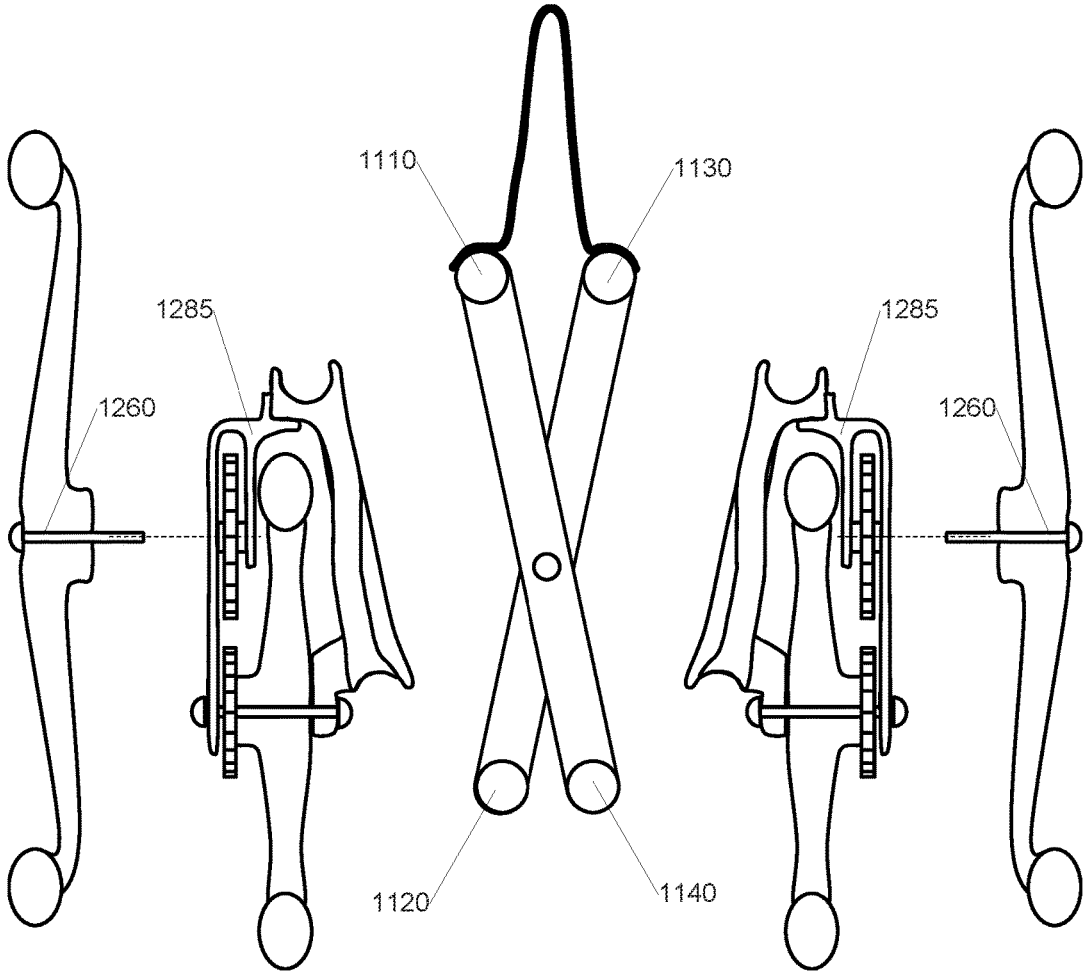
FIG. 34 is a front view diagram illustrating an example collapsible wheelchair having a removable push rim according to an implementation of the present application.

FIG. 34 is a front view diagram illustrating an example collapsible wheelchair having a drive train guard fork 1285 and a removable push rim 1240 according to an implementation of the present application. In the illustrated embodiment, the push rim 1240 is removable from the collapsible wheelchair by disengaging the push rim axle 1260 from the second extension of the drive train guard fork 1285 and sliding the push rim 1240 and push rim axle 1260 away from the wheelchair to cause the push rim axle 1260 to exit each of the through holes in the first and second extensions of the drive train guard fork 1285 and the push rim sprocket 1270. Advantageously, the entire collapsible wheelchair can be easily separated into at least five separate parts for convenient and compact storage.

Figure 35:
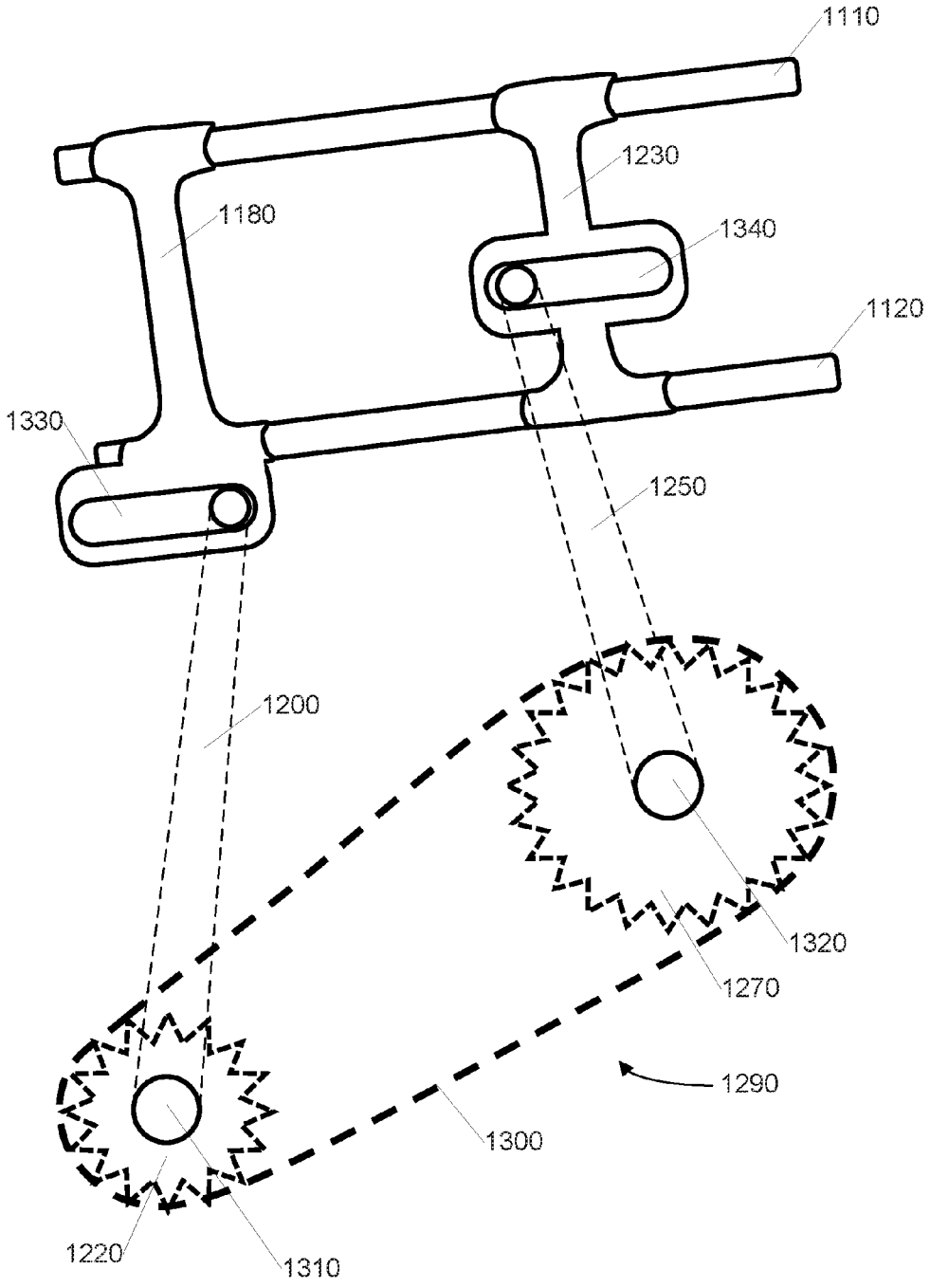
FIG. 35 is an expanded side view diagram illustrating an example drive train orientation with respect to the first brace and the second brace and first and second axes of rotation according to an implementation of the present application.

FIG. 35 is an expanded side view diagram illustrating an example drive train 1290 orientation with respect to the first brace 1180 and the second brace 1230 and the first and second axes 1200, 1250 of rotation according to an implementation of the present application. In the illustrated embodiment the drive train 1290 comprises the drive wheel axle 1210 and the drive wheel sprocket 1220, the push rim axle 1260 and the push rim sprocket 1270, and the chain/belt 1300.

In one embodiment, the first brace 1180 comprises a first brace axle slot 1330 to allow the drive wheel axle 1210 to pass through and be secured to the first brace 1180. The drive wheel sprocket 1220 comprises a corresponding drive wheel sprocket through hole 1310 to allow the opposite end of the drive wheel axle 1210 to pass through and be secured to the drive wheel 1190. The combination of the drive wheel sprocket through hole 1310 and the first brace axle slot 1330 allows the operator to select relative positions for the drive wheel sprocket 1220 and the push rim sprocket 1270 that provide optimal tension on the chain/belt 1300 during operation of the manual wheelchair.

Figure 36:
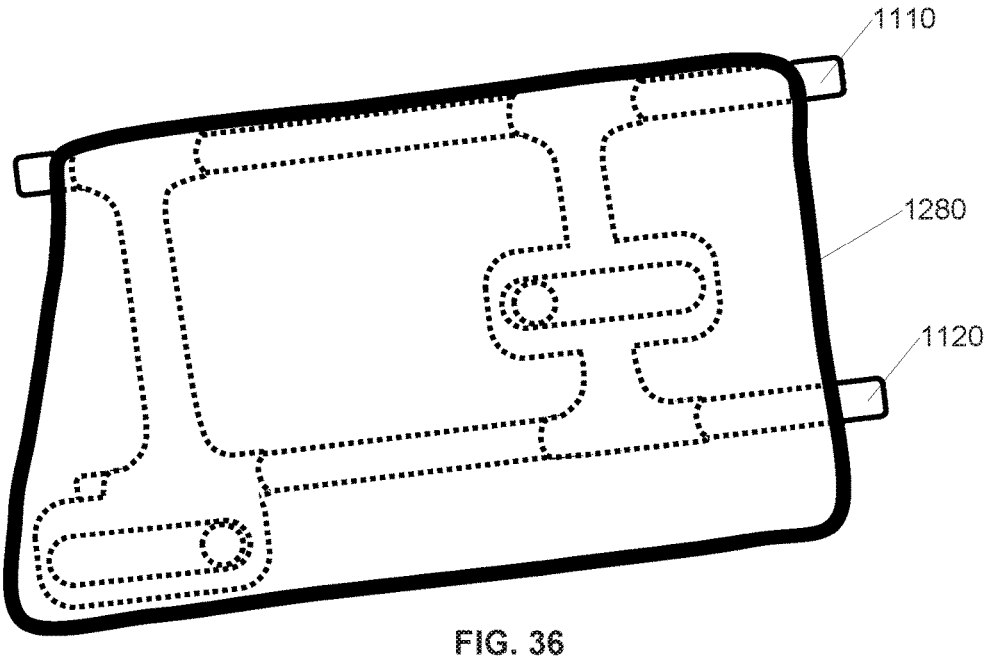
FIG. 36 is a side view diagram illustrating an example drive train guard orientation with respect to first and second lateral frame members according to an implementation of the present application.

FIG. 36 is a side view diagram illustrating an example drive train guard 1280 orientation with respect to first and second lateral frame members 1110, 1120 according to an implementation of the present application. In the illustrated embodiment, the drive train guard 1280 is secured along a portion of the surface of the first lateral frame member 1110 and is also secured to the manual wheelchair by the drive wheel axle 1210 and the push rim axle 1260 that each pass through a portion of a middle section of the drive train guard 1280.

Figure 37:
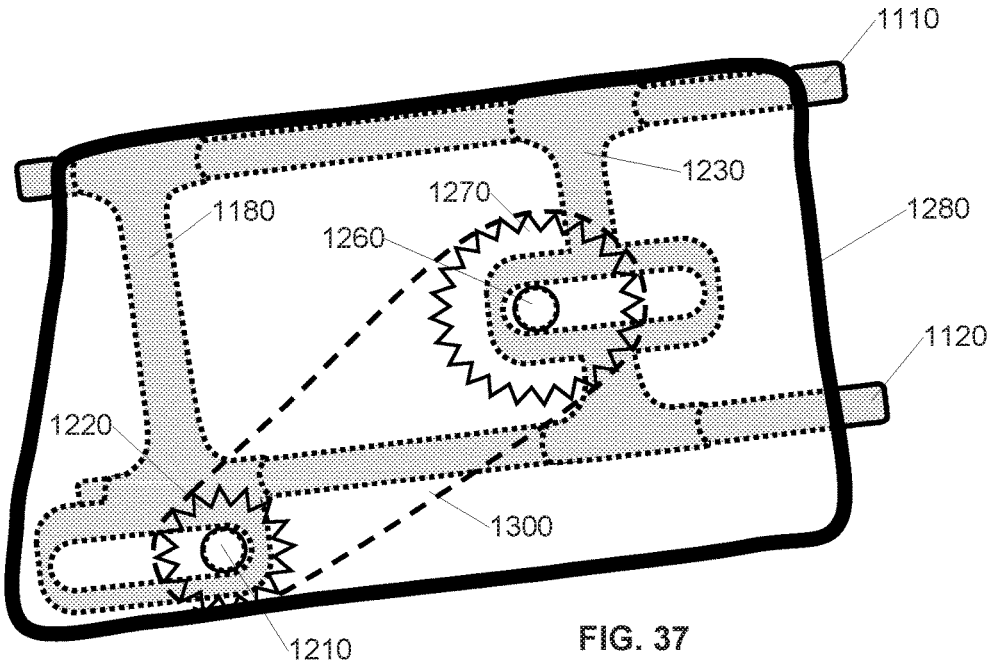
FIG. 37 is a side view diagram illustrating an example drive train guard orientation with respect to first and second lateral frame members and the drive train according to an implementation of the present application.

FIG. 37 is a side view diagram illustrating an example drive train guard 1280 orientation with respect to first and second lateral frame members 1110, 1120 and the drive train 1290 according to an implementation of the present application. In the illustrated embodiment, the drive wheel sprocket 1220 and the push rim sprocket 1270 are secured to the first brace 1180 and the second brace 1230 by way of the drive wheel axle 1210 and the push rim axle 1260. The drive train guard 1280 advantageously separates the operator of the wheelchair from the moving parts of the drive train 1290 during operation of the manual wheelchair.

Figure 38:
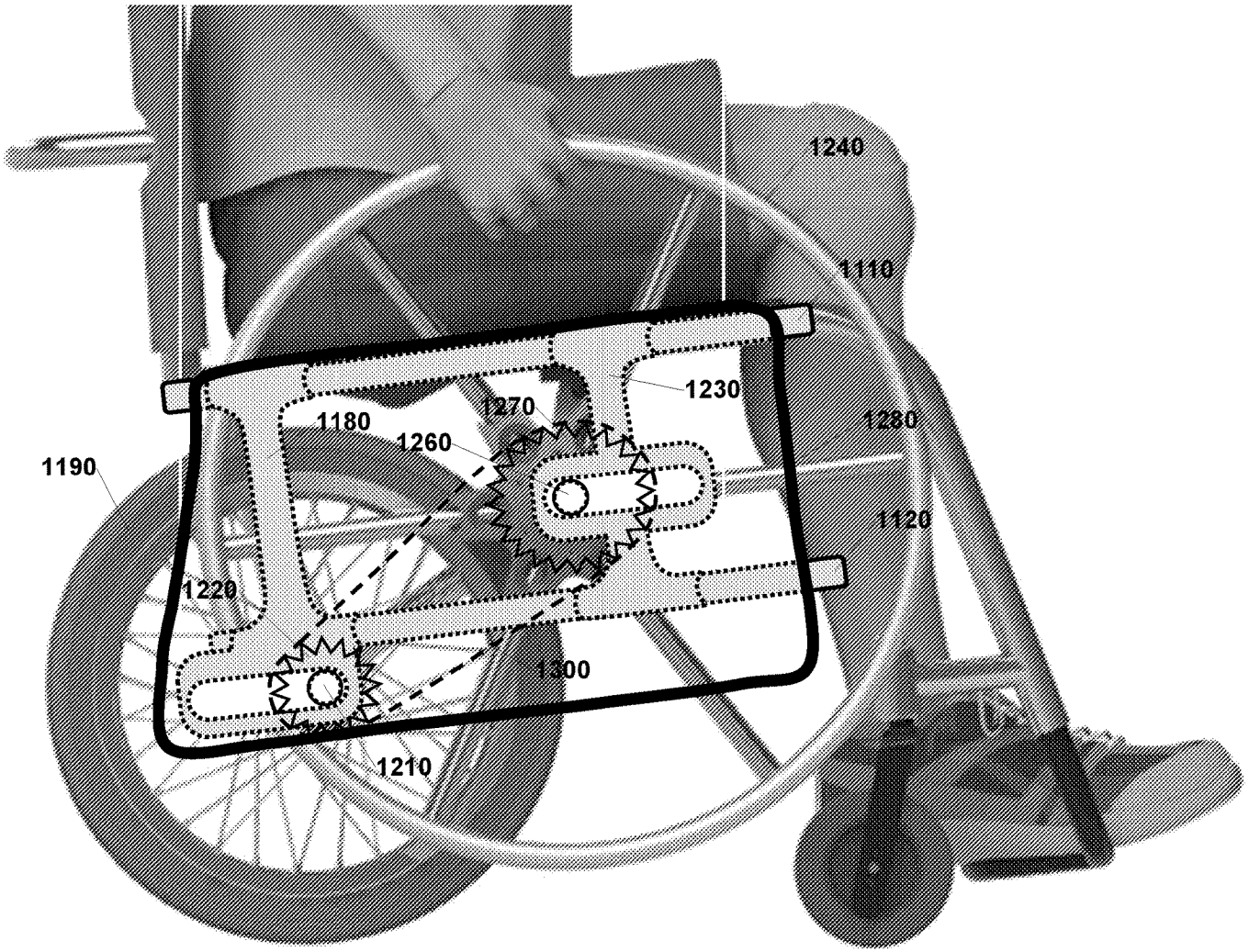
FIG. 38 is a side view diagram illustrating an example drive train guard orientation with respect to first and second lateral frame members, the drive train, the drive wheel and the push rim according to an implementation of the present application.

FIG. 38 is a side view diagram illustrating an example drive train guard 1280 orientation with respect to first and second lateral frame members 1110, 1120, the drive train 1290, the drive wheel 1190, the push rim 1240 and a collapsible manual wheelchair according to an implementation of the present application. In the illustrated embodiment, the drive wheel sprocket 1220 and the push rim sprocket 1270 are secured to the first brace 1180 and the second brace 1230 by way of the drive wheel axle 1210 and the push rim axle 1260. The drive train guard 1280 advantageously separates the operator of the wheelchair from the moving parts of the drive train 1290 during operation of the manual wheelchair.

Figure 39:
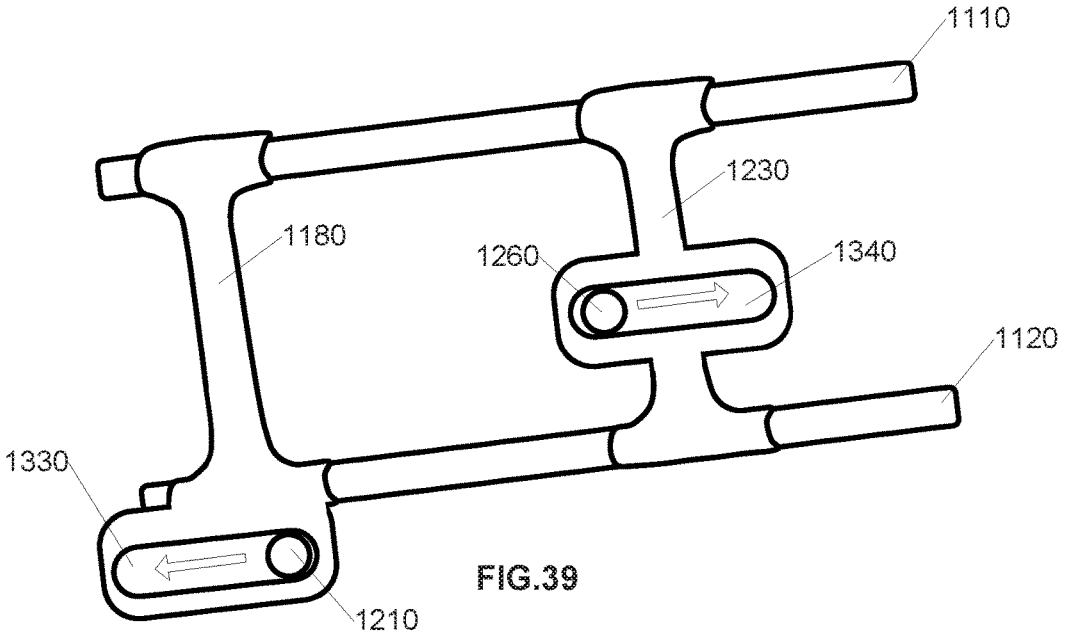
FIG. 39 is a side view diagram illustrating first and second braces having variable axle position slots according to an implementation of the present application.

FIG. 39 is a side view diagram illustrating first and second braces 1180, 1230 having variable axle position slots 1330, 1340, respectively, according to an implementation of the present application. In the illustrated embodiment, the variable axle position slot 1330 of the first brace 1180 allows the operator of the manual wheelchair to select a preferred or optimal position for orientation of the drive wheel 1190 relative to the push rim 1240. Similarly, the variable axle position slot 1340 of the second brace 1230 allows the operator of the manual wheelchair to select a preferred or optimal position for orientation of the push rim 1240 relative to the drive wheel 1190. For example, during operation of the manual wheelchair, the operator may select the relative positions to provide optimal tension on the chain/belt 1300 for ease of propulsion. Alternatively, the operator may also select the relative positions to provide ease of ingress/egress to/from the manual wheelchair.

Figure 40:
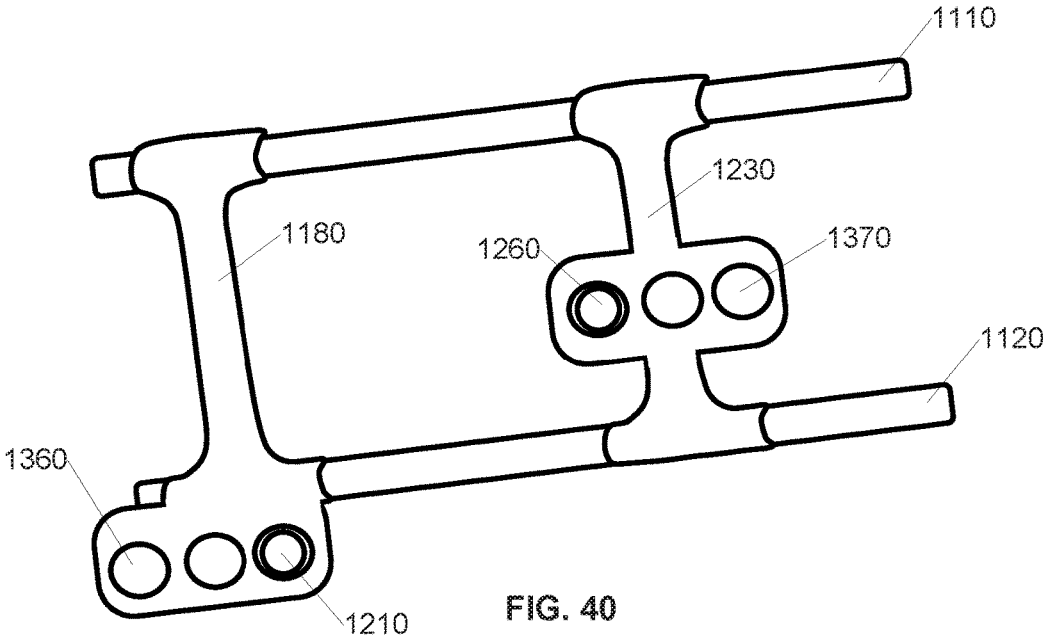
FIG. 40 is a side view diagram illustrating first and second braces having plural fixed axle positions according to an implementation of the present application.

FIG. 40 is a side view diagram illustrating first and second braces 1180, 1230 having plural fixed axle positions 1360, 1370, respectively, according to an implementation of the present application. In the illustrated embodiment, the first brace 1180 comprises a plurality of fixed position holes 1360 through which the drive wheel axle 1210 may be passed to secure the drive wheel 1190 to the first brace 1180 and thus the frame of the manual wheelchair. In one embodiment, there may be three fixed position holes 1360 but in alternative embodiments there may be more or less than three. Similarly, the second brace 1230 also comprises a plurality of fixed position holes 1370 through which the push rim axle 1260 may be passed to secure the push rim 1240 to the second brace 1230 and thus the frame of the manual wheelchair. In one embodiment, there may be three fixed position holes 1370 but in alternative embodiments there may be more or less than three.

Those of skill in the art will appreciate that skilled persons can implement the described functionality in varying ways for particular applications, but such implementation decisions should not be interpreted as causing a departure from the scope of the invention. Also, in the various embodiments described above, the improvements to the push rim and drive wheels can be implements for a single side of the wheelchair or on both sides of the wheelchair.

The above description of the disclosed embodiments is provided to enable any person skilled in the art to make or use the invention. Various modifications to these embodiments will be readily apparent to those skilled in the art, and the generic principles described herein can be applied to other embodiments without departing from the spirit or scope of the invention. Thus, it is to be understood that the description and drawings presented herein represent a presently preferred embodiment of the invention and are therefore representative of the subject matter which is broadly contemplated by the present invention. It is further understood that the scope of the present invention fully encompasses other embodiments that may become obvious to those skilled in the art and that the scope of the present invention is accordingly not limited.

What is claimed is:

1. A manual wheelchair comprising:

a collapsible frame comprising a first lateral member and a second lateral member, wherein the first lateral member positioned proximal to a seat;

a drive wheel having a first axis of rotation and configured to rotate relative to the frame;

a push rim having a second axis of rotation and configured to rotate relative to the frame, a first brace comprising a first end connected to a portion of the first lateral member and a second end having a drive wheel axle through hole aligned with the first axis of rotation, the second end further including a recess configured to engage a portion of the second lateral member;

a second brace comprising a first end connected to a portion of the first lateral member and a second end having a recess configured to engage a portion of the second lateral member, the second brace further including a middle section comprising a push rim axle through hole aligned with the second axis of rotation;

a transmission configured to transmit rotation of the push rim to rotation of the drive wheel;

wherein the second end of the first brace and the second end of the second brace are each configured to release the second lateral member to collapse the wheelchair.

2. The manual wheelchair of claim 1, wherein a drive wheel axle extends along the first axis of rotation and engages the drive wheel, the first brace, and a portion of the transmission.

3. The manual wheelchair of claim 2, wherein the drive wheel axle additionally engages a guard.

4. The manual wheelchair of claim 1, wherein a push rim axel extends along the second axis of rotation and engages the push rim, the first brace, and a portion of the transmission.

5. The manual wheelchair of claim 4, wherein the drive wheel axle additionally engages the guard.

6. The manual wheelchair of claim 4, wherein the push rim axle additionally engages the guard.

7. The manual wheelchair of claim 1, wherein the push rim is removable.

8. The manual wheelchair of claim 7, wherein the push rim axle is configured to be removed from the collapsible wheelchair.

9. A manual wheelchair comprising:

a collapsible frame comprising a first lateral member and a second lateral member, wherein the first lateral member positioned proximal to a seat;

a drive wheel having a first axis of rotation and configured to rotate relative to the frame;

a push rim having a second axis of rotation and configured to rotate relative to the frame, a first brace comprising a drive wheel axle through hole aligned with the first axis of rotation, a first end configured to engage a portion of the first lateral member and a second end configured to engage a portion of the second lateral member;

a second brace comprising a push rim axle through hole aligned with the second axis of rotation, a first end configured to engage a portion of the first lateral member and a second end configured to engage a portion of the second lateral member;

a transmission configured to transmit rotation of the push rim to rotation of the drive wheel;

wherein at least one end of the first brace and at least one end of the second brace are each configured to release the lateral members to collapse the wheelchair.

10. The manual wheelchair of claim 9, wherein a drive wheel axle extends along the first axis of rotation and engages the drive wheel, the first brace, and a portion of the transmission.

11. The manual wheelchair of claim 10, wherein the drive wheel axle additionally engages a guard.

12. The manual wheelchair of claim 9, wherein a push rim axel extends along the second axis of rotation and engages the push rim, the first brace, and a portion of the transmission.

13. The manual wheelchair of claim 12, wherein the drive wheel axle additionally engages the guard.

14. The manual wheelchair of claim 12, wherein the push rim axle additionally engages the guard.

15. The manual wheelchair of claim 9, wherein the push rim is removable.

16. The manual wheelchair of claim 15, wherein the push rim axle is configured to be removed from the collapsible wheelchair.

17. A manual wheelchair comprising:

a collapsible frame comprising a first lateral member and a second lateral member, wherein the first lateral member positioned proximal to a seat;

a drive wheel having a first axis of rotation and configured to rotate relative to the frame;

a push rim having a second axis of rotation and configured to rotate relative to the frame, a first brace comprising a drive wheel axle through hole aligned with the first axis of rotation, a first end configured to engage a portion of the first lateral member and a second end configured to engage a portion of the second lateral member;

a second brace comprising a first end configured to engage a portion of the first lateral member and a second end configured to engage a portion of the second lateral member;

a transmission configured to transmit rotation of the push rim to rotation of the drive wheel;

wherein at least one end of the first brace and at least one end of the second brace are each configured to release the lateral members to collapse the wheelchair.

18. The manual wheelchair of claim 17, wherein the push rim is removable.

19. The manual wheelchair of claim 18, wherein the push rim axle is configured to be removed from the collapsible wheelchair.

* * * * *